US006736071B2

(12) United States Patent
Engle

(10) Patent No.: US 6,736,071 B2
(45) Date of Patent: May 18, 2004

(54) RAIL CARS FOR INTERMODAL TRAIN

(75) Inventor: Thomas H. Engle, Clayton, NY (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 27 days.

(21) Appl. No.: 09/255,204

(22) Filed: Feb. 22, 1999

(65) Prior Publication Data

US 2003/0205164 A1 Nov. 6, 2003

Related U.S. Application Data

(60) Provisional application No. 60/075,579, filed on Feb. 23, 1998.

(51) Int. Cl.[7] ..... B61D 3/00

(52) U.S. Cl. ..... 105/238.1; 105/3

(58) Field of Search ..... 105/3, 4.1, 4.2, 105/4.3, 238.1, 355; 414/333, 334

(56) References Cited

U.S. PATENT DOCUMENTS

| | | | | | |
|---|---|---|---|---|---|
| 544,561 | A | * | 8/1895 | Bridegum | 213/13 |
| 4,456,413 | A | * | 6/1984 | Pavlick | 105/4 R |
| 4,652,057 | A | | 3/1987 | Engle et al. | 303/3 |
| 4,686,907 | A | * | 8/1987 | Woollam et al. | 105/4.1 |
| 4,718,351 | A | | 1/1988 | Engle | 105/4.3 |
| 4,718,800 | A | | 1/1988 | Engle | 410/61 |
| 4,750,431 | A | * | 6/1988 | Yates et al. | 105/199.2 |
| 4,805,539 | A | * | 2/1989 | Ferris et al. | 105/158.2 |
| 4,973,206 | A | | 11/1990 | Engle | 410/67 |
| 5,020,445 | A | * | 6/1991 | Adams, Jr. | 105/159 |
| 5,036,774 | A | * | 8/1991 | Curtis et al. | 105/197.1 |
| 5,207,161 | A | * | 5/1993 | Pileggi et al. | 105/199.3 |
| 5,216,956 | A | * | 6/1993 | Adams, Jr. | 105/4.2 |
| 5,222,443 | A | * | 6/1993 | Engle | 105/355 |
| 5,246,081 | A | | 9/1993 | Engle | 180/19.2 |
| 5,564,341 | A | * | 10/1996 | Martin | 105/4.1 |
| 5,651,656 | A | | 7/1997 | Hapeman | 414/537 |
| 5,722,736 | A | | 3/1998 | Cook | 303/15 |
| 6,550,400 | B1 | * | 4/2003 | Forbes | 105/458 |

* cited by examiner

*Primary Examiner*—S. Joseph Morano
*Assistant Examiner*—Robert J. McCarry, Jr.
(74) *Attorney, Agent, or Firm*—Buchanan Ingersoll, P.C.

(57) ABSTRACT

An integral intermodal train is provided for carrying standard over-the-highway semi-trailers. The intermodal train can include a standard locomotive pulling one or more train segments. Each segment can have a plurality of platforms and may be loaded or unloaded independently of any other segment using a self contained, roll-on/roll-off system. At least one platform should be equipped with a standard knuckle coupler at standard height to permit the segments to be pulled by any existing locomotive. Each segment can consist of three platform types, articulated together, an adapter platform coupled behind the locomotive, an intermediate platform having a truck at only one end and the other end supported by the end of the adapter platform and a loading ramp platform also having a truck at only one with the other end supported by the truck end of the intermediate platform. The truck end of the ramp platform can have a hinged ramp assembly which can be raised or lowered to load the platforms. Several sub-systems to speed performance and enhance reliability, such as an electronic assisted air brake, health monitoring, trailer tie-down and locomotive interface subsystems, can be provided on each segment.

63 Claims, 25 Drawing Sheets

FIG.36a
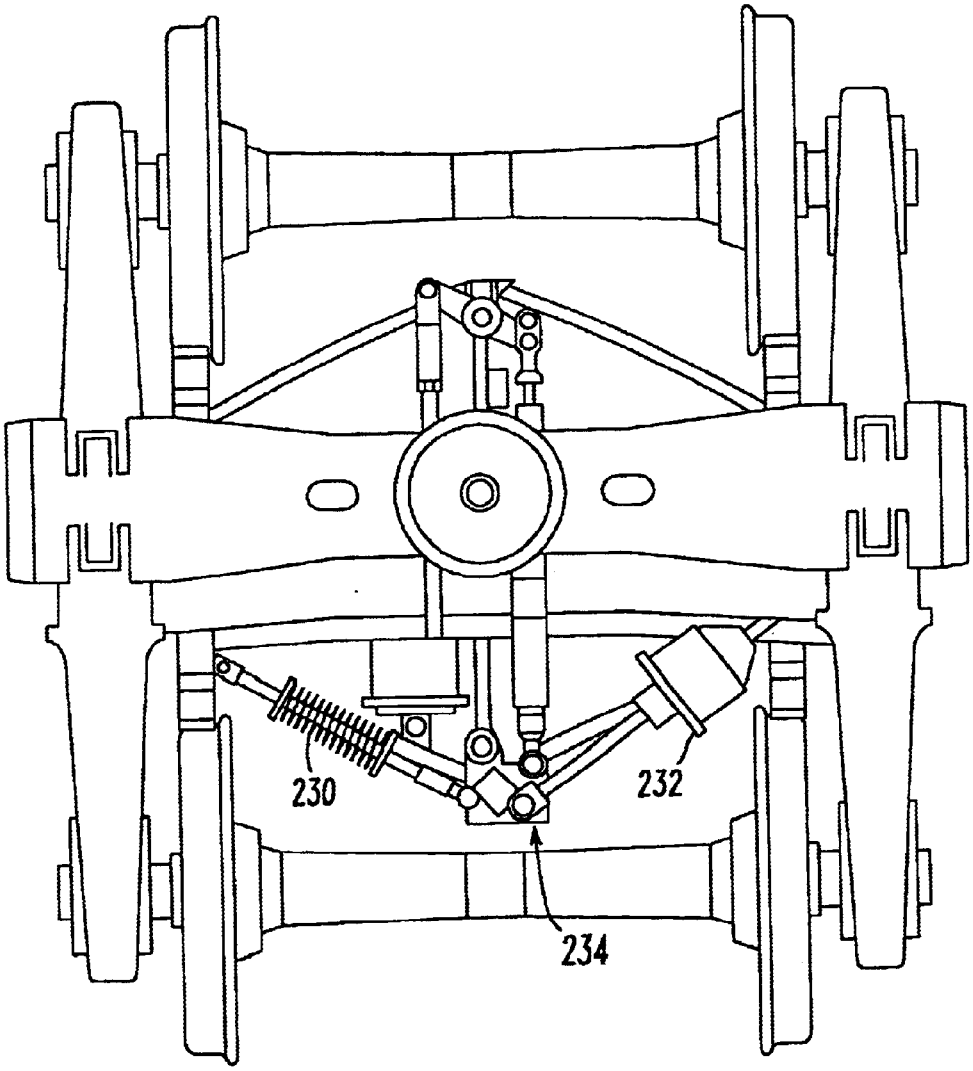
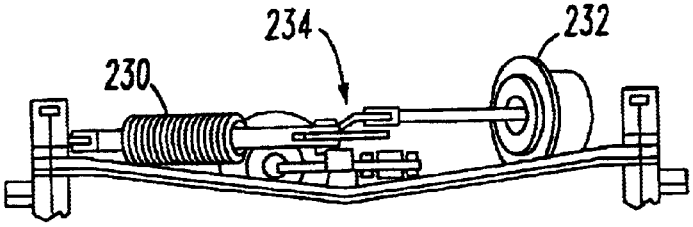
FIG.36b

RAIL CARS FOR INTERMODAL TRAIN

RELATED APPLICATIONS

This application is an continuation application of co-pending U.S. patent application Ser. No. 09/255,204, filed Feb. 22, 1999.

BACKGROUND

The present invention relates generally to rail cars for an integral/semi-integral intermodal train employing a segmented roll-on/roll-off system. More particularly, the rail cars can be connected together to form segments of an integral train for carrying freight, such as semi-trailers, wherein each train segment has an integrated arrangement composed of different types of rail car platforms, including an adapter platform, intermediate platforms and a loading ramp platform.

SUMMARY

Adapter, intermediate and ramp platform rail car platforms are provided for forming an intermodal train, is provided for carrying standard over-the-highway semi-trailers. The intermodal train can have a standard locomotive pulling one or more identical train segments. Each segment can have eleven or more platforms and may be loaded or unloaded independently of any other segment using a self contained, roll-on/roll-off system. This system can have an integral ramp on at least one end of each segment, for use by a hostler tractor and/or the semi-trailers as they are being loaded or unloaded. The platforms which make up each segment can be connected by articulated joints so as to eliminate longitudinal slack and reduce costs. At least one platform should be equipped with a standard knuckle coupler at standard height to permit the segments to be pulled by any existing locomotive.

In order to permit carriage of non-railroad trailers, a very good ride quality is required; and this can be provided by premium trucks and a low 36½ inch deck height, both of which combine to permit stable operation at high speed. High speed operation is also made possible by a brake system providing actual train average braking ratios of eighteen percent nearly double that available with standard equipment. Use of this braking system can permit the Steel Turnpike to operate at speeds thirty percent higher than AAR standard freight trains, while stopping within the same distance. High speed operation is worthless in the service sensitive trailer market, however, if extremely high reliability is not possible. In order to provide this reliability, a continuously operating health monitoring system can be provided. This system signals potential problems to the operator as soon as they arise, thus permitting timely maintenance to correct defects that would otherwise cause delays, damage or equipment out-of-service problems. Properly functioning, the continuous monitoring system is capable of generally eliminating two of the most significant causes of derailment, namely broken wheels and burned off journal bearings.

It is envisioned that intermodal trains will normally consist of several segments to produce trains of over one hundred trailer capacity. In operation, advantage can be gained by using these segments in pairs with the two ramp platforms connected to each other, as will be further discussed.

Each intermodal train segment can consist of three platform types, articulated together. The first platform type is the "adapter platform," which can have a 28 inch low conveyance truck, a conventional knuckle coupler, hydraulic draft gear, carbody bolster and centerplate at one end (hereinafter referred to as the A-end); and a 33 inch truck with high capacity bearings and a female half spherical articulated connector with combined center plate (Cardwell SAC-1 type) at the other end (hereinafter referred to as the "B-end"). The adapter platform is intended to be coupled behind a standard locomotive.

The second platform type is an "intermediate platform" which can have a female articulated (SAC-1) connection and a single 33 inch truck, identical to that on the B-end of the adapter car. A male articulated connection without truck is provided at the A-end, which is supported by the mating female articulation and truck at the B-end of an adjacent platform.

The third type platform is a "ramp loader platform," which is similar to the intermediate platform in that it too has only one truck at the B-end, but differs in that it is a 28 inch low conveyance type truck. Since this truck supports only about half the weight borne by those of the intermediate units, the wheels can be smaller without danger of overloading wheels, axles or bearings. The A-end of the ramp platform can have a male articulated connection to be supported by the B-end of an adjacent platform, in like manner as the intermediate platform. At the B-end of the ramp platform, the deck extends beyond the truck, and is supported by a conventional carbody bolster and centerplate rather than an articulated connection. Use of the 28 inch truck at the B-end location allows the deck height of the end of the ramp platform car to be reduced from the 36½ inch height of the rest of the train down to 31½ inches at the B-end truck centerline. This height can be further reduced by angling the extended deck toward the ground, resulting in a final deck height at the end sill of only 17¼ inches.

Since the B-end of the ramp platform is so much lower than the normal 34½ inch coupler height, an unconventional coupler arrangement is required, particularly if it is to be coupled to a conventional locomotive or cars. Two configurations are proposed, the first using a standard knuckle coupler carded in an elevating draft gear. The second configuration involves using a simple rapid transit type coupler carried well below the normal 34½ inch height.

Several sub-systems intended to speed performance and enhance reliability can be provided on each segment. These are the "Electronic Assisted Air Brake," "Health Monitoring" and "Trailer Tie-Down" subsystems. A "Locomotive Interface Unit" subsystem is also required if former subsystems are to be used to best effectiveness.

Other details, objects, and advantages of the invention will become apparent from the following detailed description and the accompanying drawing Figures of certain embodiments thereof.

BRIEF DESCRIPTION OF THE DRAWINGS

A more complete understanding of the invention can be obtained by considering the following detailed description in conjunction with the accompanying drawings, wherein:

FIG. 36*a* is a top view of a truck equipped with the spring applied parking brake shown in FIG. 34.

FIG. 36*b* is an end view of the truck shown in FIG. 36*a*.

DESCRIPTION OF CERTAIN PREFERRED EMBODIMENTS

Figure 1:
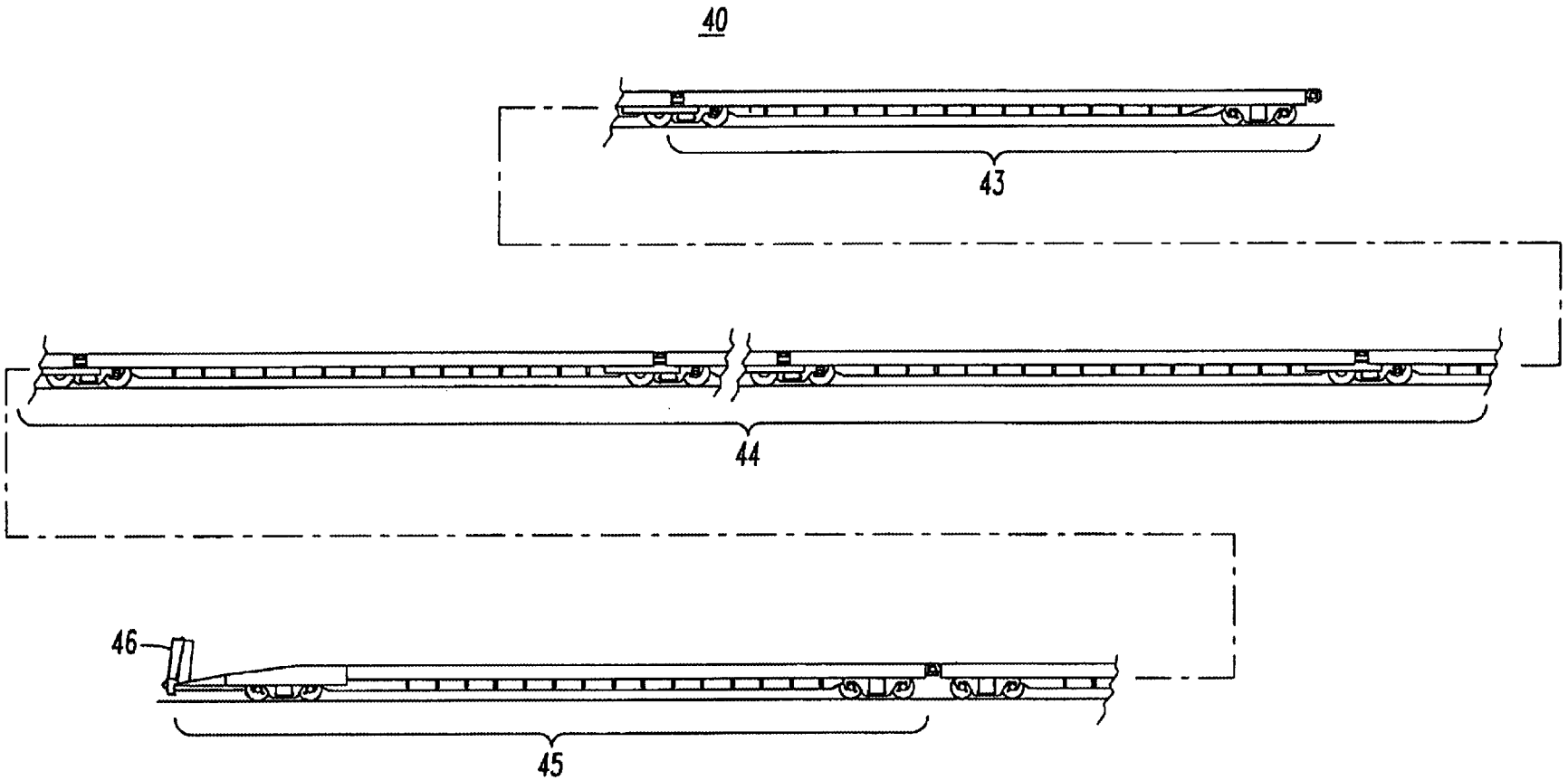
FIG. 1 is a side view of a presently preferred embodiment of an intermodal train segment

A presently preferred embodiment of a semi-integral, intermodal train segment 40, intended to carry standard over-the-highway (non-AAR) semi-trailers is shown in FIG. 1. An intermodal train may consist of a standard locomotive pulling one or more identical train segments 40. Each segment 40 includes at least three, and preferably eleven or more platforms 43, 44, 45 and may be loaded or unloaded independently of any other segment 40 using a self contained, roll-on/roll-off system. This system includes an integral ramp 46 on an end ramp loader platform 45 of each segment 40, for use by the special hostler tractor and the semi-trailers as they are being loaded or unloaded. The platforms 43, 44, 45 which make up each segment 40 are connected by articulated joints so as to eliminate longitudinal slack and reduce costs, but at least one platform is equipped with a standard knuckle coupler 47 at standard height to permit the segments to be pulled by any existing locomotive. No terminal infrastructure is required other than an area at least 75 feet long, whose surface is graded to approximately the height of the top of rail.

In order to permit carriage of non-railroad trailers, a very good ride quality is required; and this can be provided by premium trucks and a low 36½ inch deck height, both of which combine to permit stable operation at high speed. High speed operation is also made possible by a brake system providing actual train average braking ratios of eighteen percent nearly double that available with standard equipment. Use of this braking system permits the Steel Turnpike to operate at speeds thirty percent higher than AAR standard freight trains, while stopping within the same distance. High speed operation is worthless in the service sensitive trailer market, however, if extremely high reliability is not possible. In order to provide this reliability, a continuously operating health monitoring system is provided. This system signals potential problems to the operator as soon as they arise, thus permitting timely maintenance to correct defects that would otherwise cause delays, damage or equipment out-of-service problems. The continuous monitoring system is capable of absolutely eliminating two of the most significant causes of derailment, namely broken wheels and burned off journal bearings.

It is envisioned that such intermodal trains will normally consist of several segments 40 to produce trains 40 of over one hundred trailer capacity. In operation, it can be advantageous to use the segments 40 in pairs with two ramp platforms 45 connected to each other end-to-end, as will be further described.

Each intermodal train segment 40 includes three platform types 43, 44, 45, articulated together. Each end of each platform type is, for purposes of description, assigned one of two names, referred to previously as the A-end and the B-end. The forward end of such platform will be referred to as the A-end while the rearward end will be called the B-end. The first of the three types of platforms is the adapter platform 43, which is shown in more detail in FIGS. 2–5. The adapter platform 43 has a 28 inch low conveyance truck 48, a conventional knuckle coupler 46, hydraulic draft gear 49, standard carbody bolster 60 shown best in FIG. 15, and a centerplate 61 at the A-end. At the B-end, the adapter platform 43 has a 33 inch truck 51 with high capacity bearings and a female half spherical articulated connector 50 with combined center plate, which can be a standard Cardwell SAC-1 type connector. The adapter platform 43 is intended to be coupled behind a standard locomotive. The construction of the carbody bolster 28 inch truck 48 mounting at the A-end is shown in more detail in FIG. 15, and is more fully described in connection with that figure. Similarly, the structure of the B-end is shown in more detail in FIG. 16 and is described more fully in connection with that figure.

Figure 3:
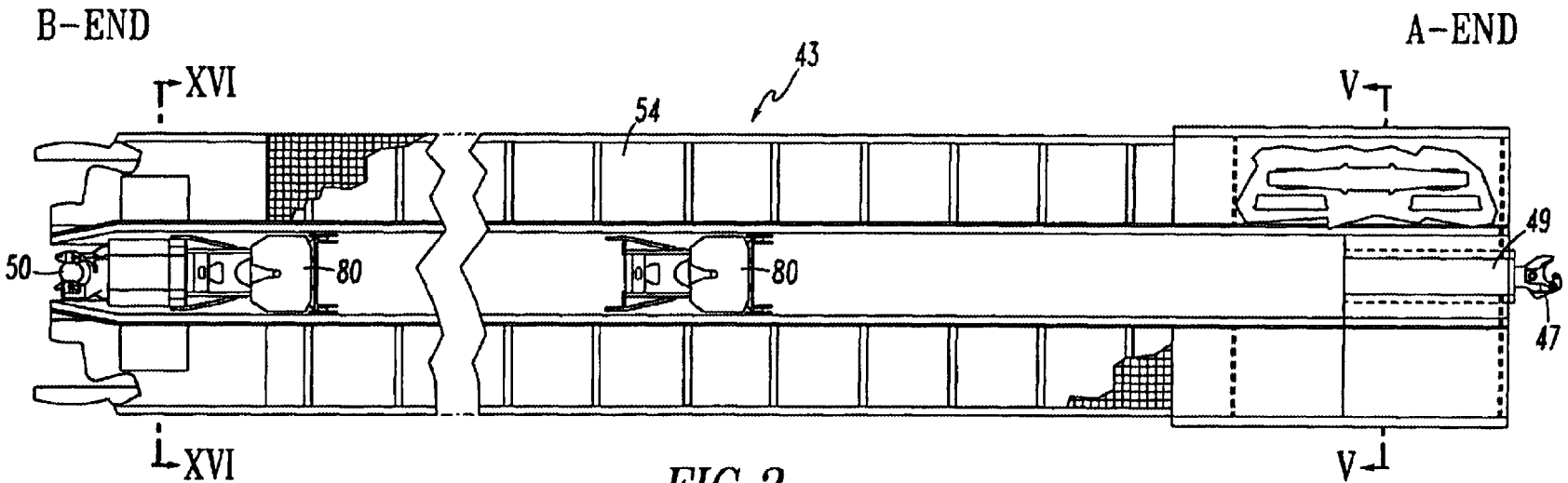
FIG. 3 is a top view of the adapter platform shown in FIG. 2.
Figure 4:
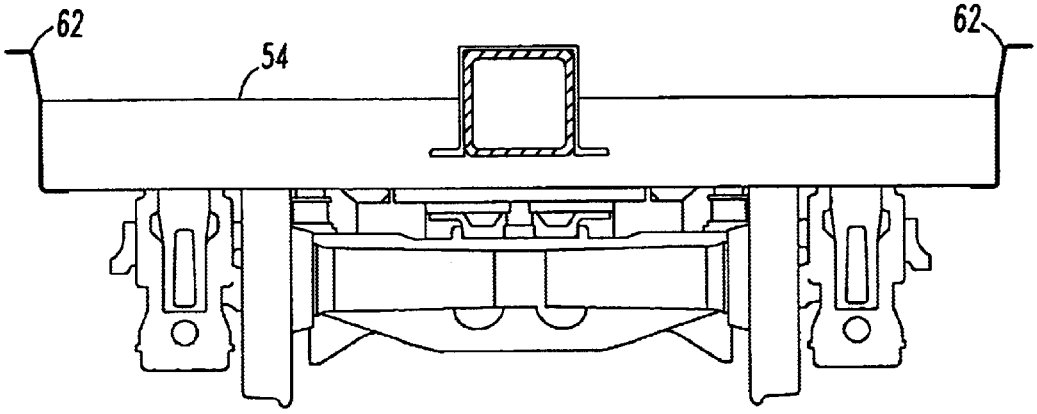
FIG. 4 is an end view of the adapter platform shown in FIG. 2.
Figure 5:
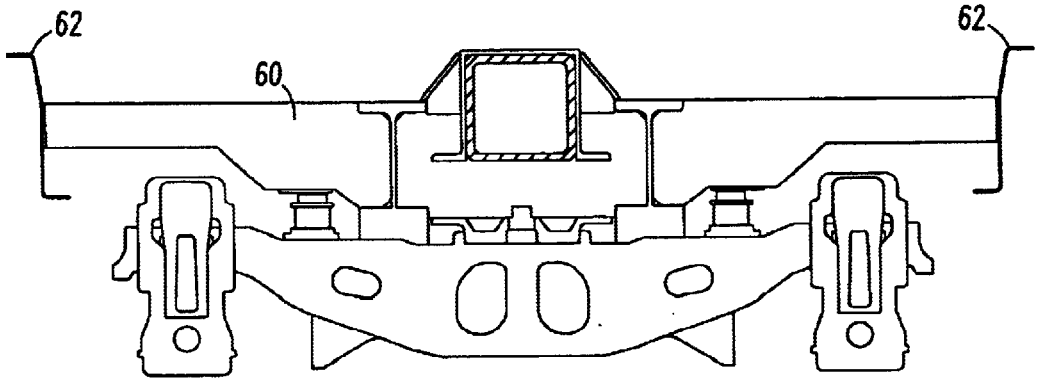
FIG. 5 is a section view taken along the line V—V of FIG. 3.

The second platform type is the intermediate platform 44, shown in FIG. 3, also having a female articulated (SAC-1) connection 50 and a 33 inch truck 51 at its B-end which is identical to the truck 51 on the B-end of the adapter car 43. A male articulated connection 52 without a truck is provided at the A-end of the intermediate platform 44. The A-end is of the intermediate platform 44 is supported by the mating female articulation connector 50 and truck 51 at the B-end of an adjacent platform.

The third type platform is the ramp loader platform 45, shown in FIGS. 11–14. The ramp platform 45 is similar to the intermediate platform 43 in that it too has a truck 48 only at the B-end. However, the truck 48 at the B-end of the ramp platform 45 differs in that a 28 inch low conveyance type truck 48, as on the adapter platform 43, is used. Since this truck 48 supports only about half the weight borne by the 33 inch trucks 51 of the intermediate platforms 43, the wheels can be smaller without danger of overloading the wheels, axles or bearings. The A-end of the ramp platform 45 also has a male articulated connection 52 which is supported by the truck 51 at the B-end of an adjacent platform, in like manner as the intermediate platforms 44, and mates with a female articulated connector 50. At the B-end of the ramp platform 45, the deck 54 has an extended, sloped portion 56 which protrudes beyond the truck 48, and is supported by a conventional carbody bolster 60 and centerplate rather than an articulated connection. Use of the 28 inch truck at this location allows the deck 56 height of the end of the ramp platform 45 to be reduced from the 36½ inch height of the other platforms 43, 44 down to 31½ inches at the B-end truck centerline of the ramp platform 45. Consequently, the height that the loading ramp 46 must rise to allow roll-on loading can be significantly reduced. This height is further reduced between the truck centerline and the ramp platform end sill by angling the sloped portion 56 toward the ground, resulting in a final deck height at the end sill of only 17¼ inches. This low height is easily reached by a short, lightweight ramp assembly 46 which is hinged to the ramp platform 45 end sill. The ramp can be raised to a stored position for travel, or lowered to a loading position by a ramp positioning device, such as, for example, an air cylinder under the control of an attendant at the terminal.

Since the B-end of the ramp platform 45 is so much lower than the normal 34½ inch coupler height, an unconventional coupler arrangement is required, particularly if the ramp platform 45 is to be coupled to a conventional locomotive or car. Presently, there are two preferred configurations, shown in FIGS. 22–27. One configuration, shown in FIGS. 24–27, uses a standard knuckle coupler 47 carried in an elevating draft gear 49, similar in concept to the retractable couplers used on passenger train locomotives through the 1950's. The other configuration, shown in FIGS. 22–23 and 28–33, is useful if, in operation, the ramp platform 45 is only to be coupled to a similar ramp platform 45 of a different train segment 40. In this latter case, a simple rapid transit type coupler 107 carried well below the normal 34½ inch height will suffice. Both constructions are described in more detail below in connection with FIGS. 22–33.

Several unique sub-systems, intended to speed performance and enhance reliability are provided on each segment. These include an Electronic Assisted Air Brake, Health Monitoring, and Trailer Tie-Down subsystems. A locomotive interface system is also required if these are to be used to best effectiveness. A brief description of each sub-system is included below, as well as more detailed descriptions of each of the three platform types.

Platform Types

Figure 2:
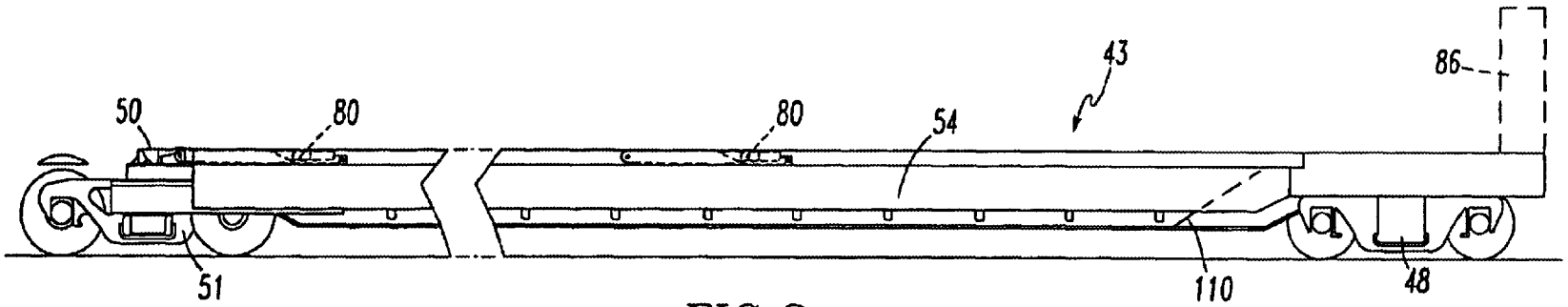
FIG. 2 is an enlarged side view of an embodiment of an adapter platform for the intermodal train shown in FIG. 1.

Each platform can have the same basic structure except for the ends. The intermediate platform 44 can serve as the "standard" platform from which the adapter and ramp platforms can be created. The economics are thus greatly improved because the standard platform can be mass produced and the other two platforms can be constructed simply by modifying the ends of the standard platform. For example, the adapter platform 43 is constructed by basically cutting the A-end off an intermediate platform 44 and welding on the modified A-end of an adapter platform 43. In FIG. 2, a splice line 110 indicates generally where the A-end of the intermediate platform 44 is cut off and the A-end configuration of the adapter platform 43 is welded on.

Figure 11:
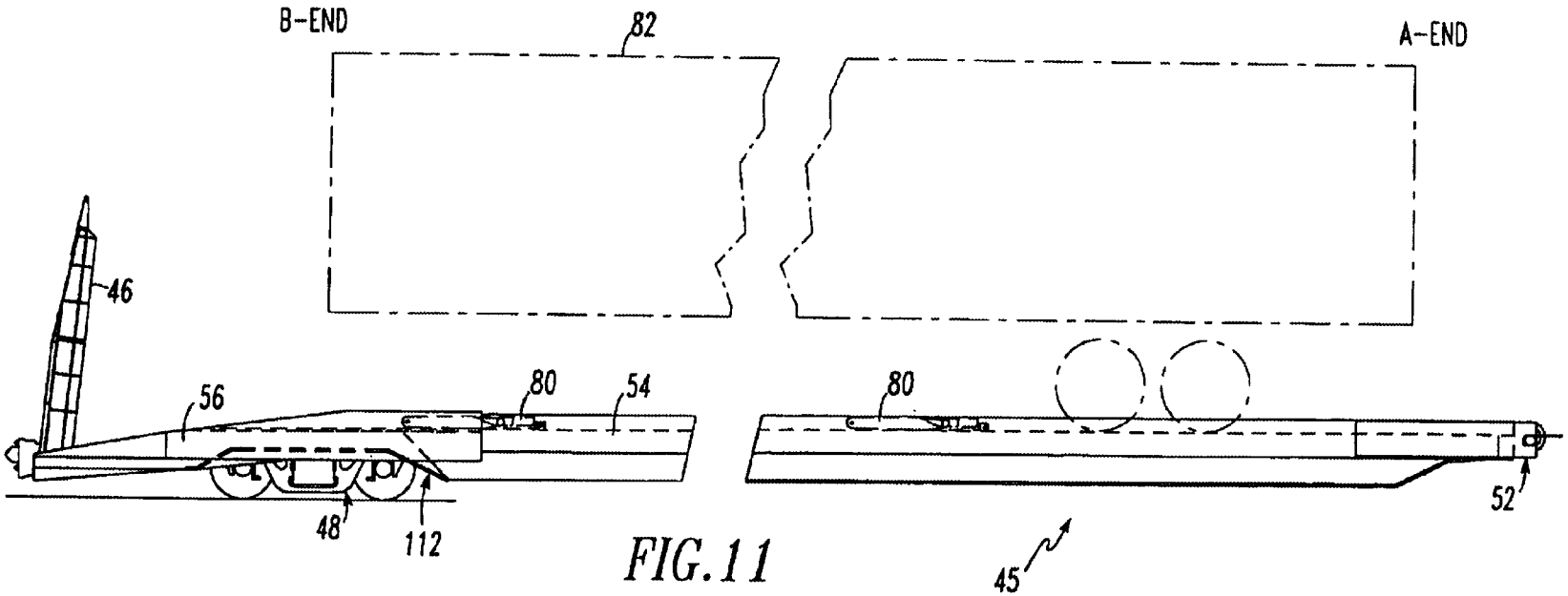
FIG. 11 is a side view of the ramp platform shown in FIG. 1.

Referring to FIG. 11, another splice line 112 indicates generally where the B-end of the intermediate platform 44 is cut off for the attachment of the B-end configuration for the ramp platform 45. Making the intermediate platform 44 the "standard" makes sense because each segment 40 of the intermodal train has preferably at least nine intermediate platforms 44 and only one each of the adapter 43 and ramp 45 platforms.

Adapter Platform

The adapter platform 43, as mentioned, has one conventional knuckle coupler 47 on its A-end, and one truck at each of the A- and B-ends. The coupler 47 is carried by a 15 inch travel "buff only" hydraulic draft gear 49, while the trucks proposed are both of the swing motion type. The A-end truck 48 is a 28 inch low conveyance model with normal seventy ton bearings and axles, while the B-end truck 51 is a 33 inch wheel model equipped with oversize bearings. These trucks 48, 51 provide improved ride and tracking characteristics as compared to a standard three-piece truck. Constant contact "teks pac" type side bearings are proposed in order to control truck hunting at high speed. Use of this type truck is required if conventional (non-AAR) trailers are to be carried, because general service trailers should not be lifted, have softer springs and lack the longitudinal strength specified by AAR for conventional piggyback service.

Figure 15:
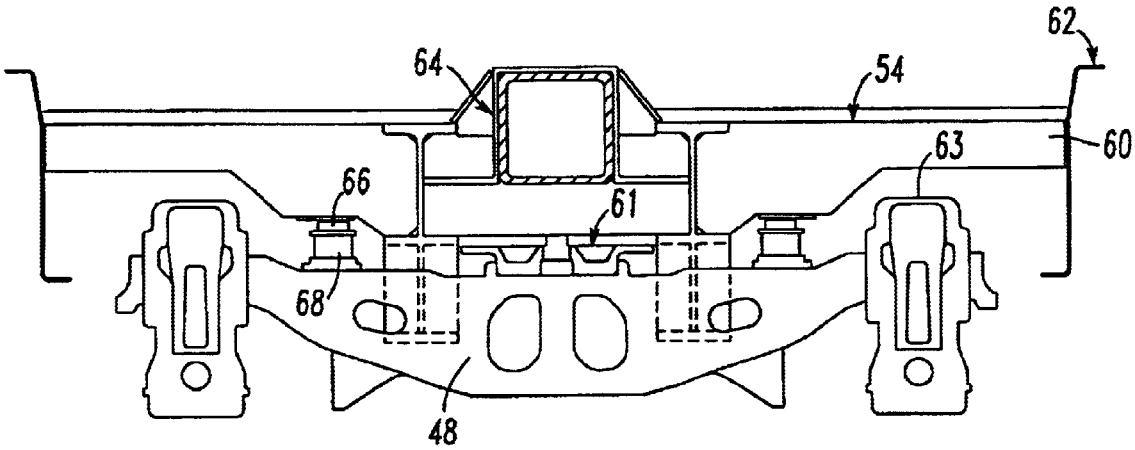
FIG. 15 is an enlarged view of the section view in FIG. 5.
Figure 16:
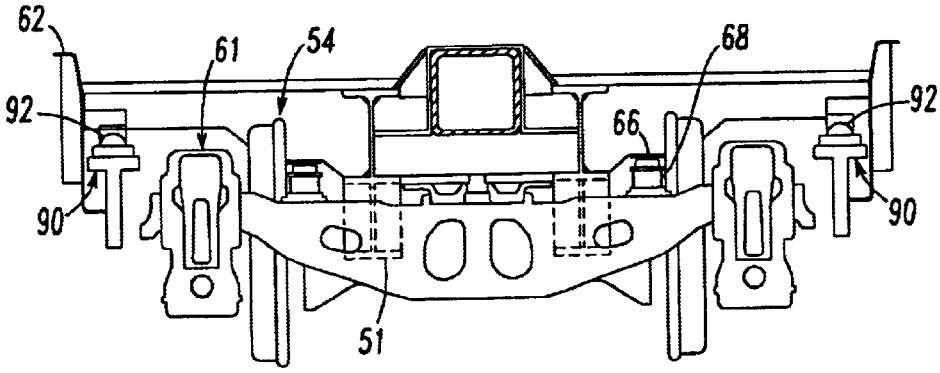
FIG. 16 is a sectional view through line XVI—XVI in FIG. 3.

An enlarged cross sectional view of the construction of the carbody bolster 60 and 28 inch truck 48 mounting at the A-end is shown in FIG. 15, while FIG. 16 shows a similar view taken at the B-end. FIG. 16 illustrates the unique construction of the platform over the B-end 33 inch trucks 51 which is common to all of the intermediate platforms 44. Of particular importance is the fact that there is no carbody bolster 60 over the truck side frame 63. This allows the deck 54 to be brought down to the desired height with only a minimum deck thickness above the side frame 63, as shown in FIG. 16.

The A-end of the adapter car 43 uses a conventional carbody bolster 60 and center plate 61 as well as the previously mentioned 15 inch hydraulic draft gear 49 and F-type knuckle coupler 47. Use of this draft gear 49 is recommended because of the slack-free nature of the segment 40 and is particularly important when coupling to a locomotive or conventional equipment, as the long articulated train structure would otherwise act as a huge single mass, and if coupled to at any but the lowest speed, could cause damage to the couplers and other parts of the conventional equipment.

Figure 17:
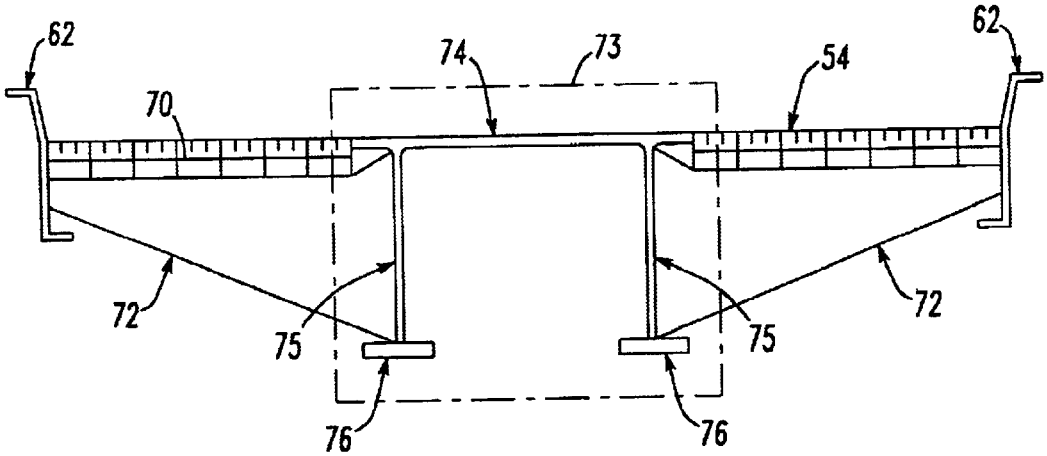
FIG. 17 is an enlarged view of the section view in FIG. 9.

The deck 54 of each platform 43, 44, 45 is preferably made from steel gratings 70 supported by formed gussets 72 running from the center sill 73 of the platform to the side sills 62, as shown best in FIG. 17. The side sills 62 are formed channels and are set above the height of the deck 54 so as to provide curbs which aid in preventing a trailer from being inadvertently pushed off of the deck when backing into loading position.

The use of grating 70 for the deck 54 is aimed primarily at making the deck 54 self-clearing of snow and ice, as precipitation dropping on it can simply fall through to the rail or track bed below and need not be removed by snow blowers, plows or other apparatus. The center sill 73 is not a conventional AAR construction, but instead is constructed from a wide box beam, open at the bottom and fabricated with relatively light weight webs 75, and having a top plate 74 and bottom flanges 76 of differing thickness along the length of the structure so as to properly resist vertical bending, which is maximum at the center. This "tapered flange" approach reduces weight where bending stresses are not as high. Use of a relatively thin web 75 could allow buckling, but this is prevented by reinforcing the webs 75 by welding the grating support gussets 72 to the full height of the webs 75, as shown in FIG. 17.

Figure 18:
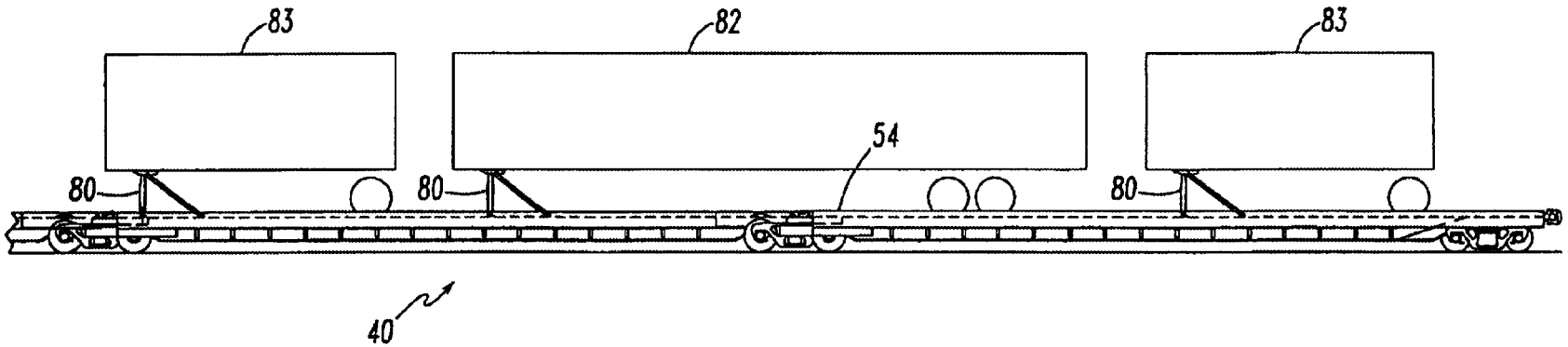
FIG. 18 is a side view of the intermodal train segment in FIG. 1 showing a random loading arrangement of trailers.

The top of the center sill 73 is also used to support the legs of the folding or "pull-up" hitches 80 which are used to secure the nose of a trailer 82 to the deck 54 by attaching to the trailer's king pin. These hitches are well known in the railway industry, but a modified version is used on the steel turnpike because the platforms will never be humped, thus sparing the design the extreme longitudinal forces imposed by trainyard impacts during switching operations. Two such hitches are secured to the outer sill 73, one near the B-end and another 29 feet away, near the center of the platform. This hitch spacing permits any presently legal trailer 82, including the extra long 57 foot trailers (legal in only 5 western states), to be efficiently carried. At the same time, the 29 foot hitch spacing allows 28 foot long "pup" trailers 83 to be loaded with only a one foot separation between nose and tail. Likewise, as shown in FIG. 18, any combination of trailers 82, 83 can be carried, loaded in random order, with long trailers 82 spanning the articulation if necessary.

The articulating connection is essentially identical at all articulated joints between each platform. At the B-end of the adapter 43 and ramp 44 platforms, upper side bearings 66 are provided to transfer any roll of the platform into the truck bolster and suspension system. Constant contact side bearings are preferably used on the truck bolster in order to both minimize carbody roll relative to the bolster, and to add rotational damping to the truck 51 as an aid to controlling truck "hunting" during high speed operation. FIG. 16 shows the upper 66 and lower 68 side bearing set up, and it can be seen that, unlike normal car building practice, there is no carbody bolster 60 extending beyond the side bearings 66, 68. It is this bolsterless construction that permits the 37 inch deck height, as use of a carbody bolster 60 would add the thickness of this part to the minimum clearance above the truck side frame 63 that is used.

At the B-end side sills, a roll stabilizer bearing shelf 90 is provided which can withstand high vertical loads. This bearing shelf 90 cooperates with a bearing shoe 92 on the A-end side sills 62 of an adjacent platform 44. This construction, shown best in FIG. 16, results in a roll stabilizer bearing which essentially connects adjacent decks 54 torsionally, which will greatly reduce carbody roll on less than perfect track. This is particularly important where trailers 82 are being carried bridging an articulated joint, because this construction reduces racking of the trailer 82 that relative roll could otherwise induce.

Figure 19:
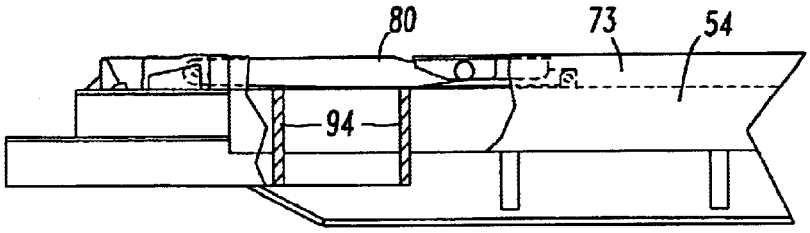
FIG. 19 is a side view partially in section of the B-end of either the adapter platform or intermediate platform illustrating the connections of the side cells to the center cell to resist vertical bending.
Figure 20:
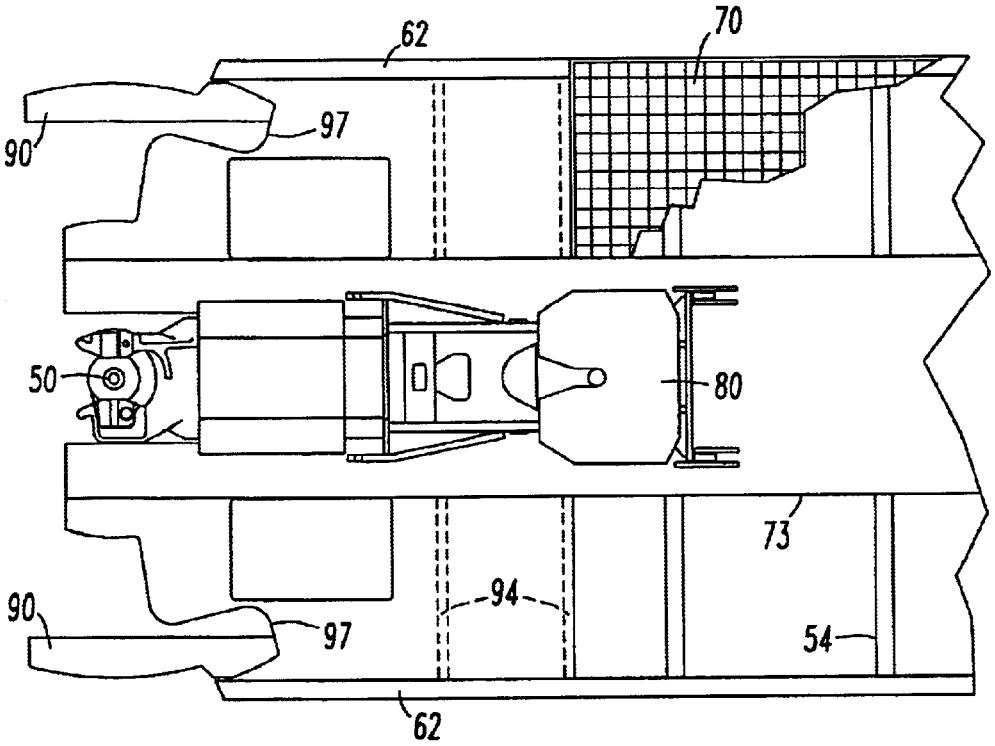
FIG. 20 is a top view partially in section of the B-end of the platform shown in FIG. 19.

Near the B-end of the adapter 43 and intermediate 44 platforms, but inboard of the truck, are a pair of structural connections 94 extending from the left side sill 62 to the left side of the center sill 73 to the right side of the center sill 73 and thence to the right side sill 62, as shown in FIGS. 19 and 20. These connections 94 are made up of the two cross connections 94 and the center sill 73 top cover plate 74 and provides the necessary vertical load carrying capacity to the side sills 62 as would be given by the carbody bolster 60 connection in a conventional carbody construction, but without introducing the additional height of the conventional carbody bolster 60 as previously discussed. That is, these connections 94 support the ends of the side sills 62 and transmit vertical side sill 62 loads into the center sill 73.

Figure 21:
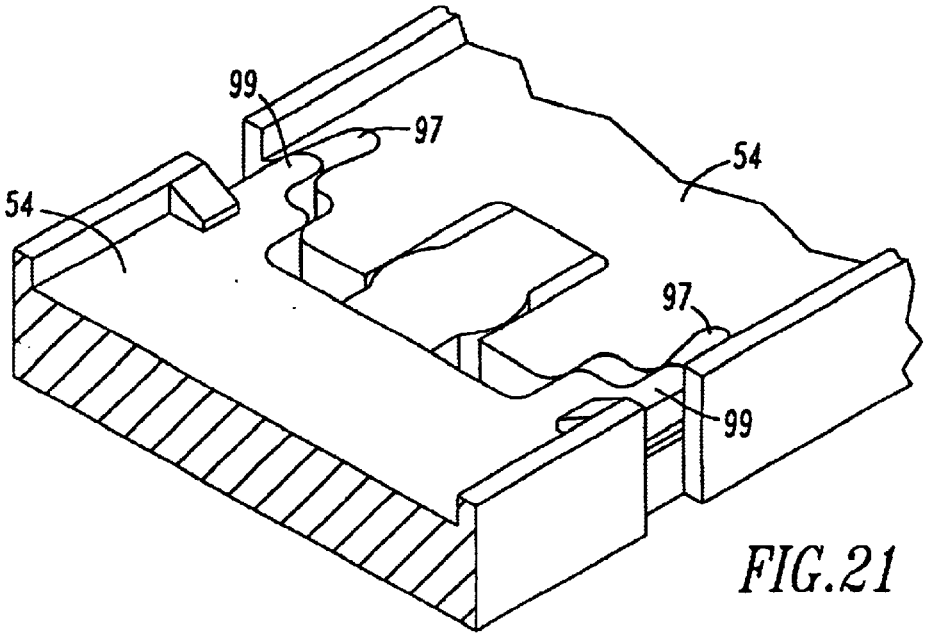
FIG. 21 is a perspective view, partially in section, showing the interleaved deck structure.

An interleaved deck structure, shown best in FIG. 21, is preferably provided where the decks 54 of each articulated platform 43, 44, 45 mate. For example, as shown, at the deck connection of the adapter platform 43 to the first intermediate platform 44, the deck structure 54 is interleaved with its mate in such a way that when the segment 40 rounds a curve there is no scraping of one platform's deck 54 on top of the other, as would be the case for a conventional bridge plate left in the lowered position. An advantage of interlacing the deck end structures in this manner, which is common at all the articulations, is that an uninterrupted platform is provided from end to end of the entire segment, which has been shown to greatly speed the loading process. As shown, the B-end of the deck 54 has a slotted curvature 97 near each side sill 62 into which can be received a correspondingly curved extension 99 of the A-end of an adjacent deck 54 when the articulated platforms round a curve.

Referring back to FIG. 16, the construction at the A-end of the adapter platform 43, is more conventional in that it does have a carbody bolster 60, stub AAR center sill 64, a center plate 61 and draft gear attachments 49. Unlike the intermediate 44 and ramp 45 platforms, however, the adapter platform 43 A-end supports only one end of one platform, thus carrying much less weight than the other trucks 51. This permits the use of the 28 inch diameter wheel truck 48 under the A-end which provides an additional 5 inches over the truck frame 63 and permits the application of the aforementioned wide box beam center sill 73.

One other feature of the adapter platform 43 is that it permits the use of a 36 inch high bulkhead 86 at the A-end which would prevent driving a trailer off platform end of the car in the event of operator error.

Intermediate Platform

Figure 6:
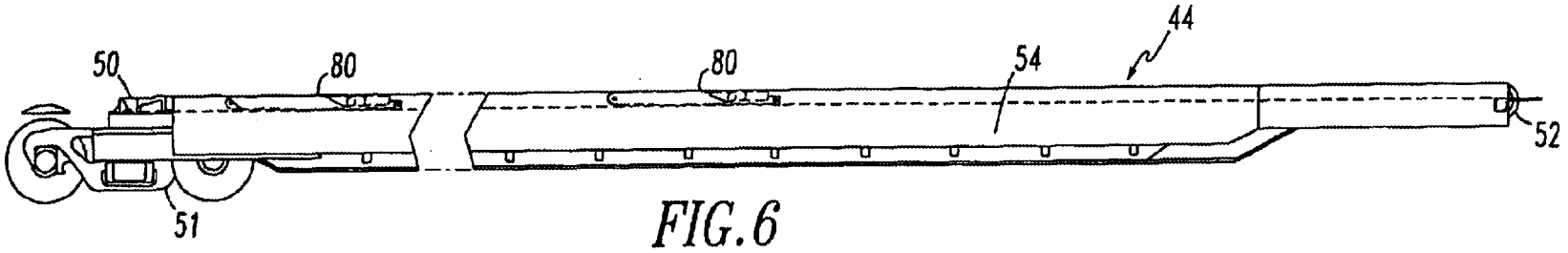
FIG. 6 is a side view of the intermediate platform shown in FIG. 1.
Figure 7:
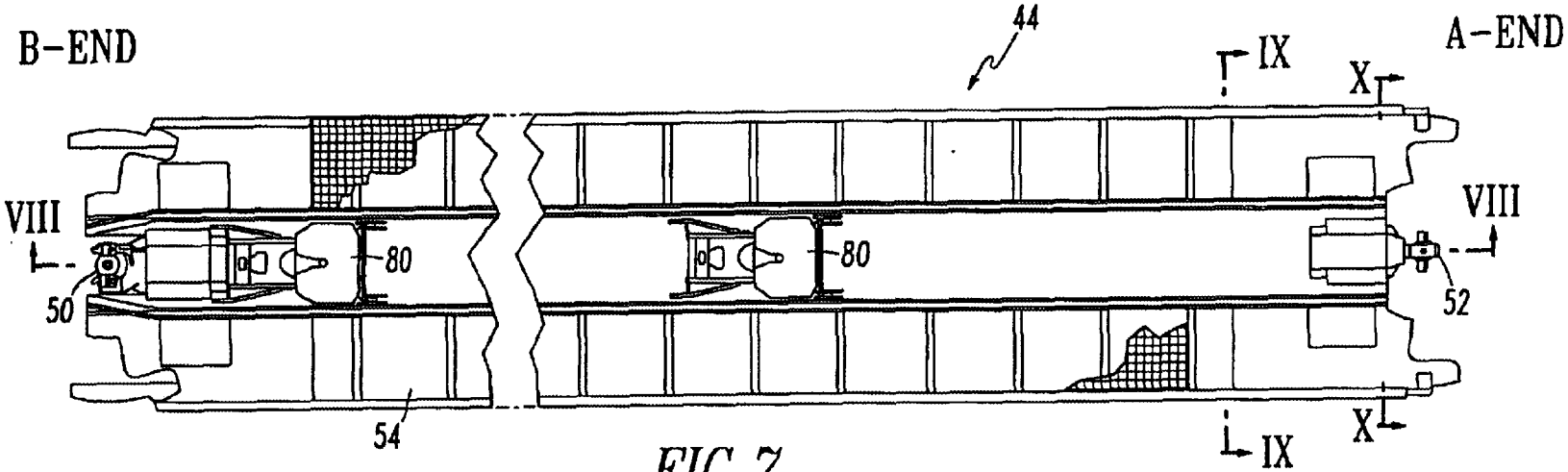
FIG. 7 is a top view of the intermediate platform shown in FIG. 6.
Figure 8:
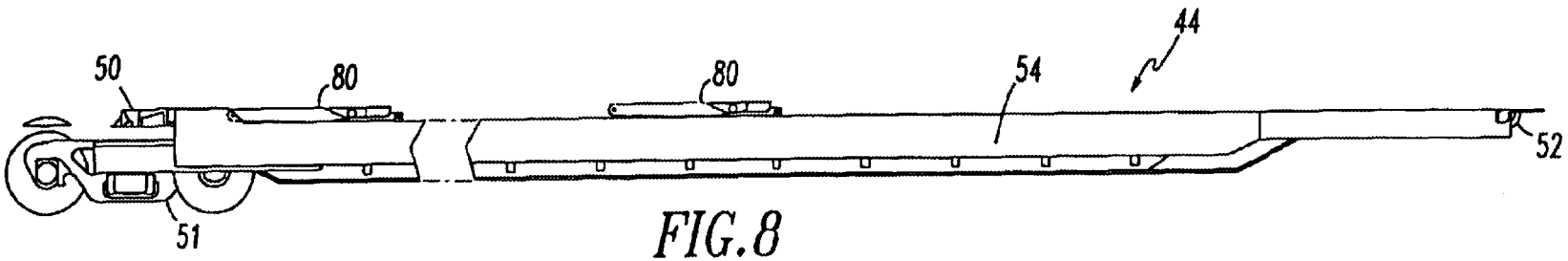
FIG. 8 is a section view taken along the line VIII—VIII in FIG. 7.
Figure 9:
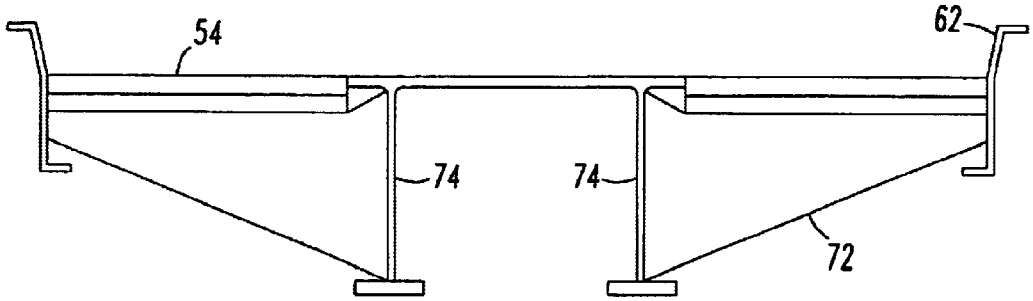
FIG. 9 is a section view taken along the line IX—IX in FIG. 7.
Figure 10:
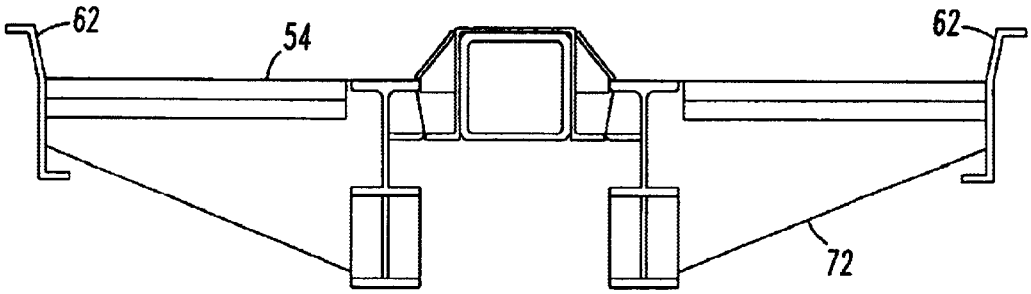
FIG. 10 is a section view taken along the line X—X in FIG. 7.

The intermediate platform 44, shown in FIGS. 6–8, shares almost all of the features above described, except that it has a truck 51 at the B-end only, and the center sill 73 connection to the side sills 62 is essentially identical at both ends. The A-end of the center sill 73 carries a male articulation joint connector 52. The articulated joint proposed, Cardwell Westinghouse SAC-1 type, is designed to take the weight of the platform 44 from the male half 52 into the female half 50 at the B-end of an adjacent platform and thence down into the truck 51 associated with the female connector 50.

Additionally, the A-end has the aforementioned bearing shoes 92 and the B-end has the bearing shelves 90. The side bearings 66, 68 of the truck 51 are used to steady the B-end of the intermediate platform 44 against roll motion, and the bearing shelves 90 cooperate with the bearing shoes 92 on the A-end of an adjacent platform, in the manner same described for the adapter platform 43, to provide roll stability. This coupling of adjacent platform side sills 62 results in the stabilizing of the A-end of the intermediate platform 44 by the B-end of an adjacent platform. This, of course, implies that the B-end of the intermediate platform 44 is stabilized in roll by the side bearings 66, 68 of an associated truck, which is insured by using constant contact side bearings.

Any number of intermediate platforms 44 may thus be assembled into a segment 40 with one adapter platform 43 at the head and one ramp platform at the tail. A presently preferred intermodal train segment 40 would consist of 11 platforms, namely, one adapter platform 43, 9 intermediate platforms 44, and 1 ramp platform 45. This particular combination is preferred primarily to achieve economy in the braking system and easy interchangeability of intermediate platforms 44 in groups of three within a segment 40, so as to produce longer or shorter segments, or effect repairs without unduly withdrawing equipment from service.

Ramp Loader Platform

Figure 13:
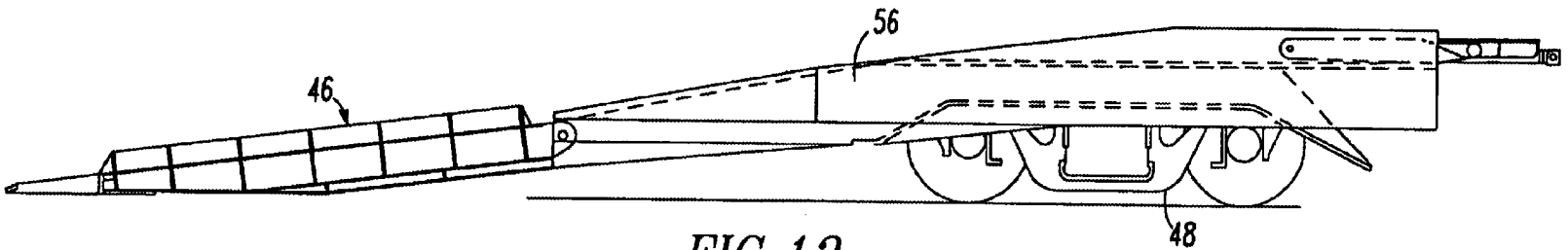
FIG. 13 is a side view partially in section of FIG. 11 showing the ramp in a lowered position.
Figure 12:
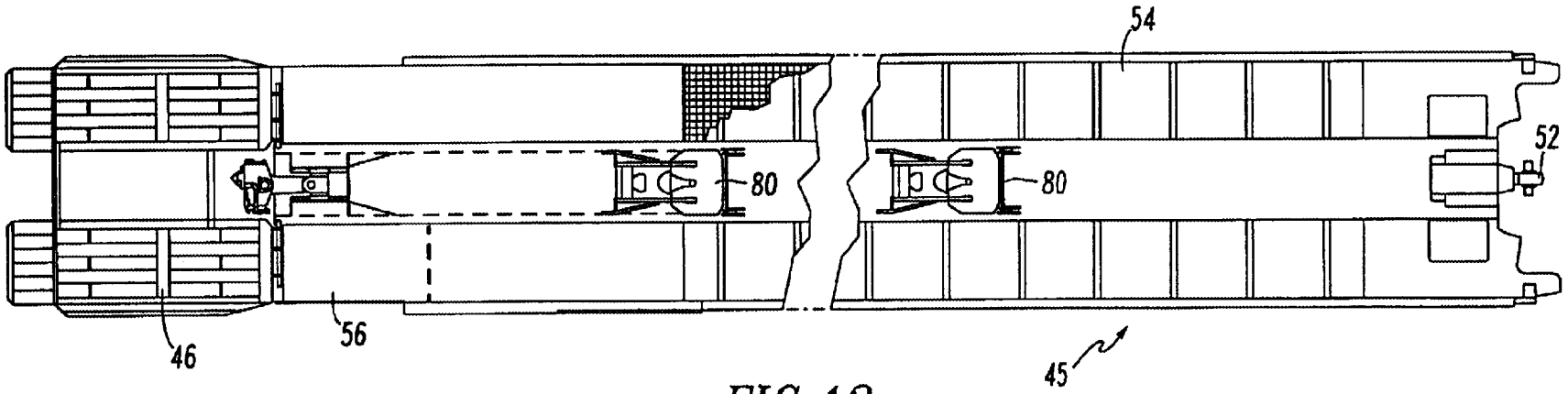
FIG. 12 is a top view of the ramp platform shown in FIG. 11.
Figure 14:
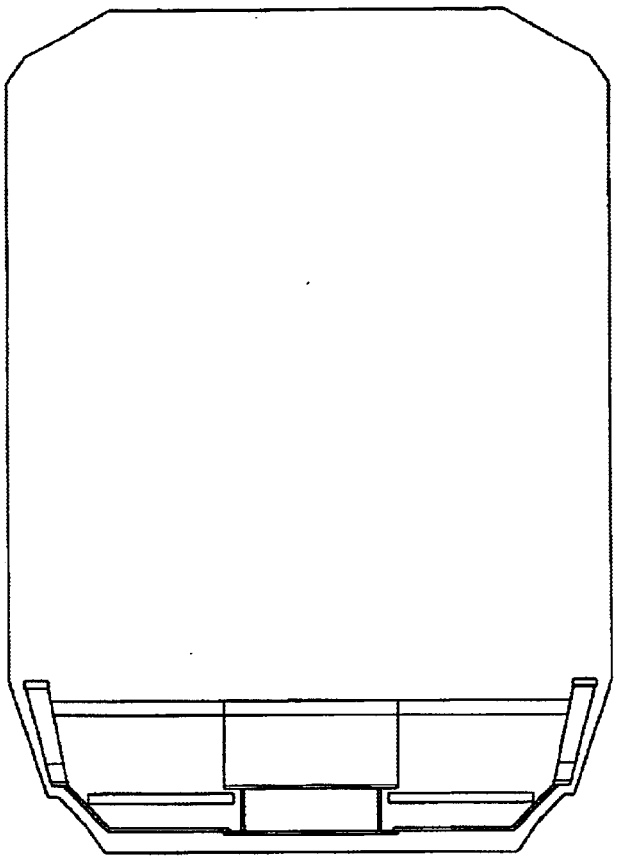
FIG. 14 is an end view of the ramp platform shown in FIG. 11 with the ramp raised.

The ramp platform 45, shown in FIGS. 11–13, is very similar to the intermediate platform 44 in that it has a truck 48 only at the B-end and depends on the sliding connection of the side sills 62 to provide roll stability at the A-end. The aforementioned sliding connection being the frictional engagement of the bearing shoes 92 on the A-end of the ramp platform 45 with the bearing shelves 90 on the B-end of an adjacent platform 44.

Referring to the drawing, the B-end employs a 28 inch wheel diameter truck 48 in a similar manner as the A-end of the adapter platform 44, but does not have a carbody bolster. The lower deck height at the 28 inch truck 48 is instead used to reduce the deck height at the B-end below 32 inches by sloping the length of the ramp platform 45 from 37 inches at the A-end down to 32 inches at the B-end. The ramp platform 45 is otherwise identical to the adapter 43 and intermediate 44 platforms.

The reduction in deck height at the end of the ramp platform 45 where the ramp 46 is attached reduces the length of ramp 46 necessary to climb from ground level to the deck. This length can be further reduced by sloping an extended portion 56 of the deck downward beyond the B-end truck, at the same slope as the ramp 46 will use (approximately 1 in 8) by lowering the end of the ramp platform 45 at its attachment point to the ramp 46. The length, and hence the weight, of the ramp 46 are greatly reduced by this technique, thus allowing simplification of the ramp lifting and stowing mechanism.

As a result, the deck height at the B-end of the ramp platform 45 is only 17¼ inches above top of the rail at the end sill. Hinged to the car structure at this point is the loading ramp 46 which has a length of only about 10 feet 3⅝ inches. This short ramp length can be efficiently counterbalanced throughout its operating angle of over 90 degrees by the use of a spring tensioning device 160, shown in FIGS. 22–33, mounted on the end of the ramp platform 45. At the full up position, the center of gravity of the ramp 46 is slightly inboard of its pivot points, thus the lever arm is negative and the ramp 46 is producing a torque which would fold it back onto the ramp platform 45. At this point, however, positive stops provided on the ramp 46 sides prevent further folding and hooks, provided adjacent to the stops, can be manually engaged so that the ramp 46 cannot be pulled down until the hooks are manually released.

Operating in parallel with the spring balance mechanisms just described is an air cylinder 162. When the retaining hooks mentioned above have been manually released, air can be introduced into this cylinder 162 to overcome the torque caused by the small negative lever arm and start the ramp 46 down. Once this has occurred, the unbalanced portion of the weight of the ramp 46 will tend to pull the piston out of the cylinder 162 and unfold into its loading position. The speed of this operation can be easily controlled by choking the exhaust of air from the rod end of the cylinder 162. Air for operation of the cylinder 162 can be supplied from a dedicated reservoir charged by main reservoir equalizing pipe when the train is coupled. This reservoir can be sized to permit at least two operations of the ramp 46 from an initial charge of 130 psi. Provision is also preferably made to take air from a hostler tractor for this operation without requiring the hostler to charge any other part of the train's pneumatic system.

The force pulling on the air cylinder piston 162 during the ramp 46 lifting operation could be made either positive or negative. That is to say, the ramp 46 could be designed to be either slightly overbalanced or slightly underbalanced by the spring and cam mechanism 160. Underbalance is preferred as it would allow manual lowering of the ramp 46 in an emergency situation where air was not available for its operation. Likewise, underbalance would prevent the nose of the ramp 46 from bouncing as trailers are rolled up on it.

Figure 22:
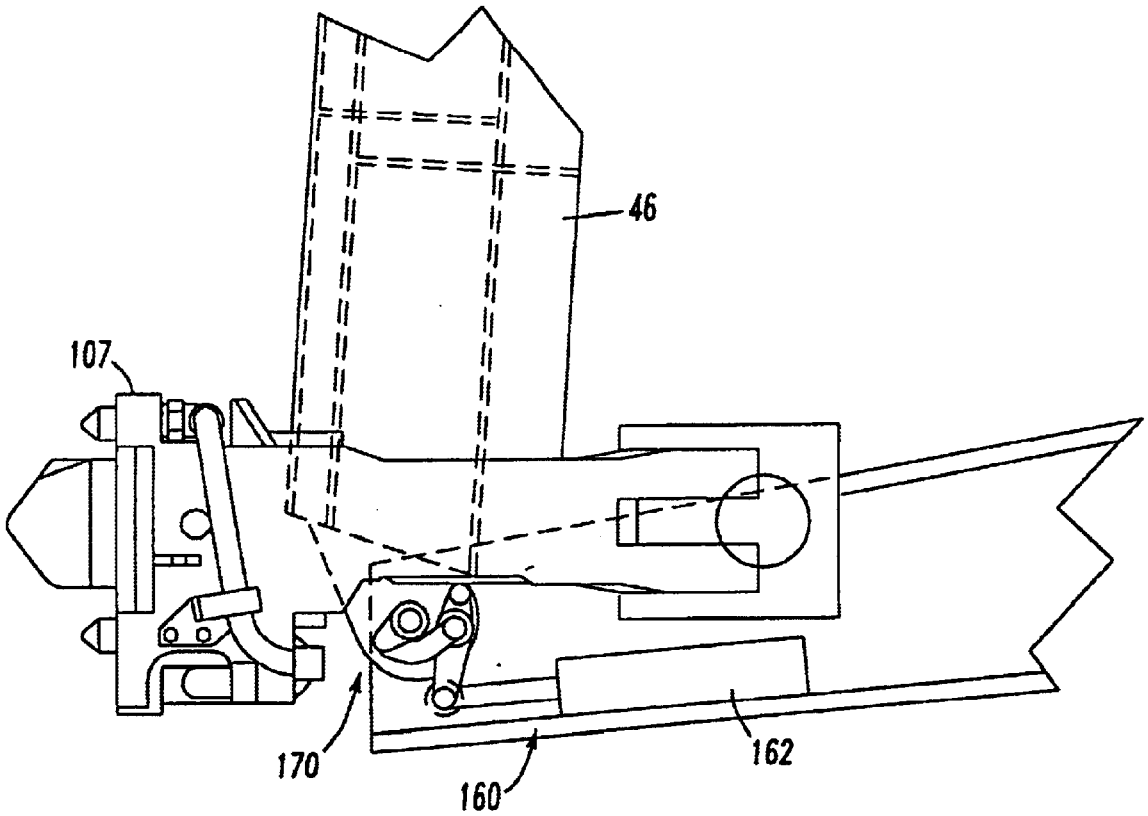
FIG. 22 is a side view partially in section of the B-end of a ramp platform and showing an embodiment of a coupler with the ramp in the raised position.
Figure 23:
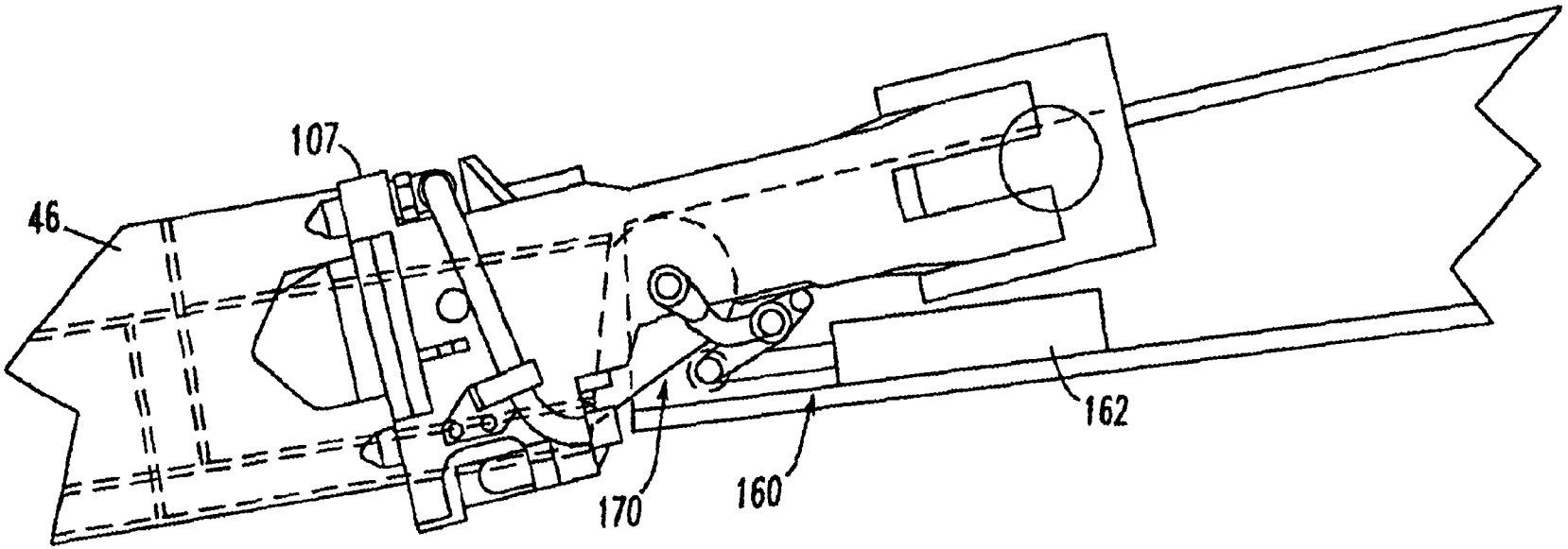
FIG. 23 is the same figure shown in FIG. 22 except showing the ramp in the lowered positioned.
Figure 24:
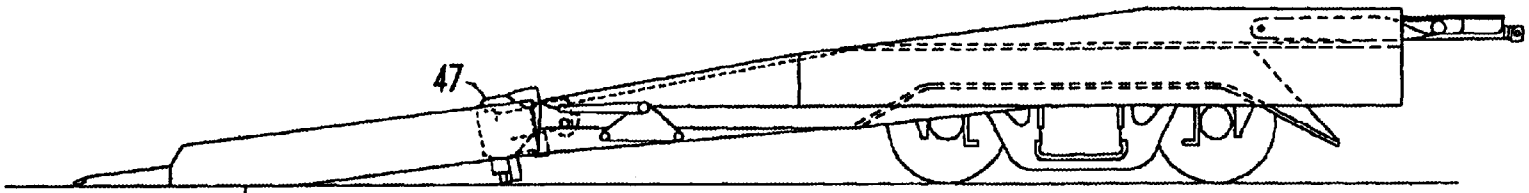
FIG. 24 is a side view partially in section of the B-end of a ramp platform showing a different embodiment of a coupler member.
Figure 25:
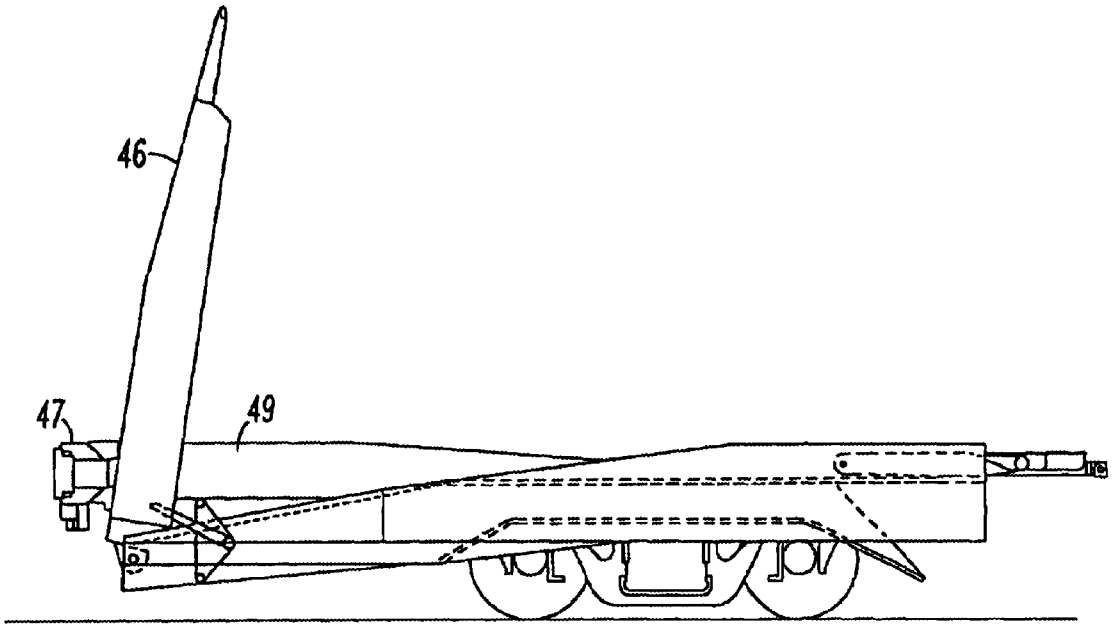
FIG. 25 is the same view as FIG. 24 except showing the ramp in a raised position.
Figure 26:
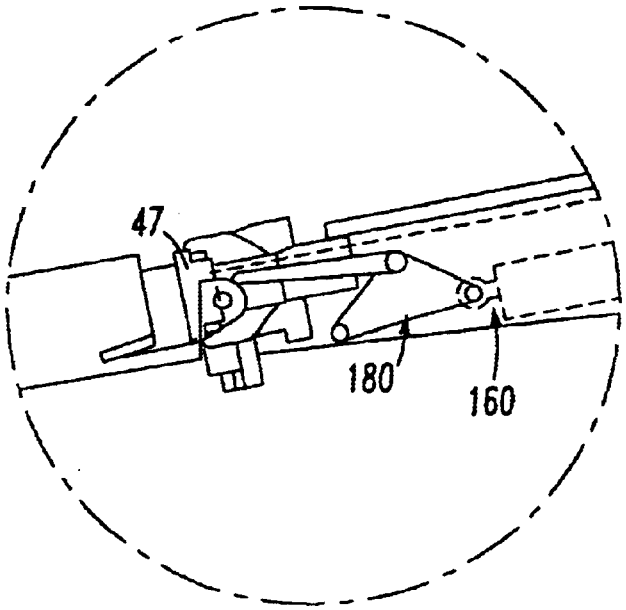
FIG. 26 is a close up view of the coupler in a lowered position as shown in FIG. 24.
Figure 27:
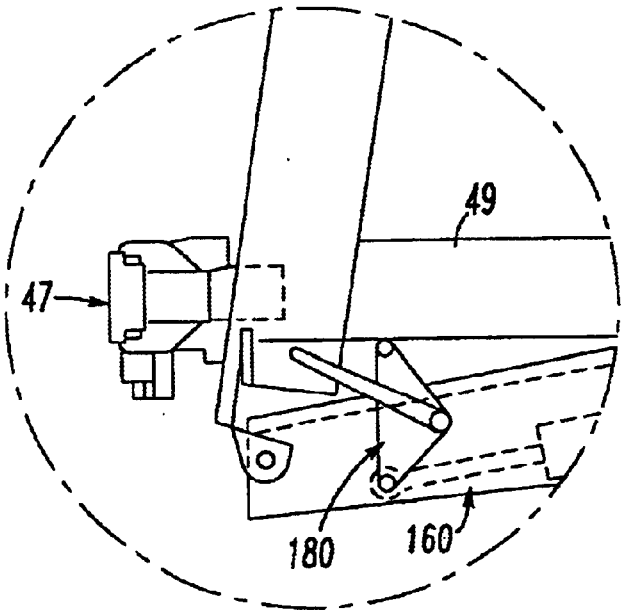
FIG. 27 is a view similar to FIG. 26 except showing the ramp in a raised positioned wherein the coupler is projecting beyond the end of the ramp platform.
Figure 28:
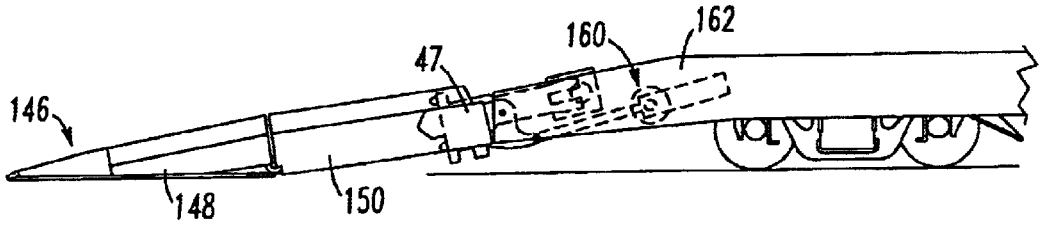
FIG. 28 is a side view partially in section of a jointed ramp member attached to the end of the ramp platform.
Figure 29:
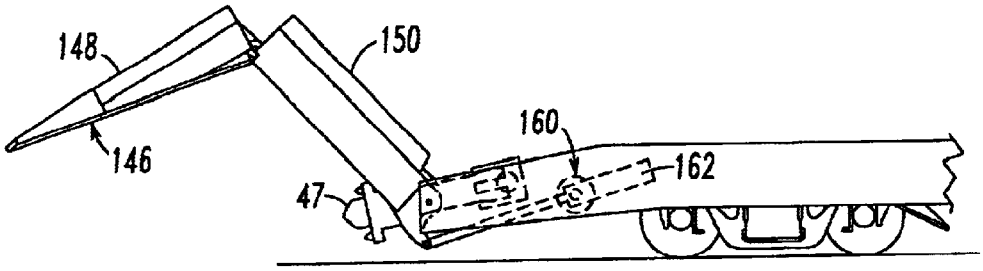
FIG. 29 is the same view as in FIG. 28 except showing the ramp in a position intermediate between the lowered and raised positions.
Figure 30:
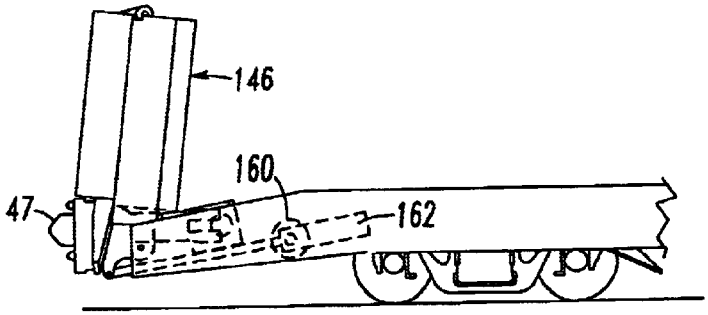
FIG. 30 is the same view as in FIG. 29 except showing the ramp in a fully retracted position.
Figure 31:
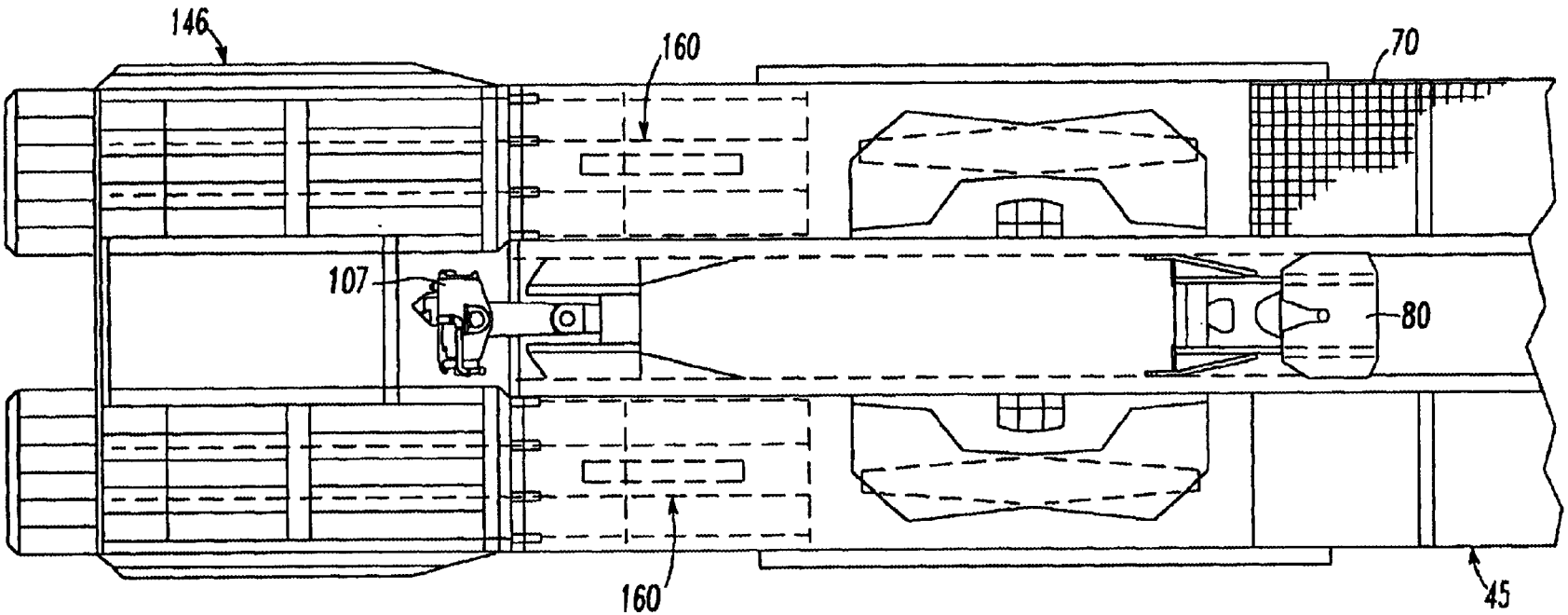
FIG. 31 is a top view, partially in section, of the ramp and ramp platform shown in FIG. 28.

As shown best in the more detailed review of the same platform coupler mechanism in FIGS. 22 and 23, when the ramp 46 is up, the coupler pulling faces extend beyond the actual ramp 46 position so as to prevent interference between the end of the ramp platform 45 and whatever platform it is coupled to. Thus, the ramp end of the platform 45 may be coupled to another ramp platform 45 with no difficulty. Further, if rapid transit type couplers 107 as shown in the drawing are used, this coupling can also effect electrical and air connections.

Two coupler connections are possible. The first, as shown in FIGS. 22–23 and 28–33, uses a transit type coupler 107 at a 20 inches height and would be a very straight forward application, but would not permit the ramp platform 45 end of a segment 40 to be pulled by conventional equipment without some sort of adapter. An alternative coupler connection shown in FIGS. 24–27, uses a standard knuckle coupler 47 and can carry it at standard coupler height. In both cases a retractable coupler is preferably used.

Referring back to FIGS. 22 and 23, after the ramp 46 has been swung up, the coupler's elevating mechanism 170 will be operated by the lifting of the ramp 46 and the linkage shown swings the coupler 107 up into operating position. It should be noted that while the coupler 107 is supported from below by the elevating mechanism 170, the flat faces of the two transit couplers will, when brought together, lift their heads a further half inch or so, so as not to have wear and interference between the elevating mechanism 170 and the mated couplers 107 when the train is traveling at speed.

In the alternative coupler 47 shown in FIGS. 24–27, a much more elaborate elevating mechanism 180 is needed because both the coupler 47 and draft gear 49 must be elevated to the standard 34½ inch height. This method permits coupling to conventional equipment with no adapter. This standard coupler 47, while more universal, would not be particularly advantageous for operations where it was desired to operate trains consisting of two segments 40 coupled ramp platform 45-to-ramp platform 45 for convenience in the terminal, and its construction is typically more complex and expensive.

Figure 32:
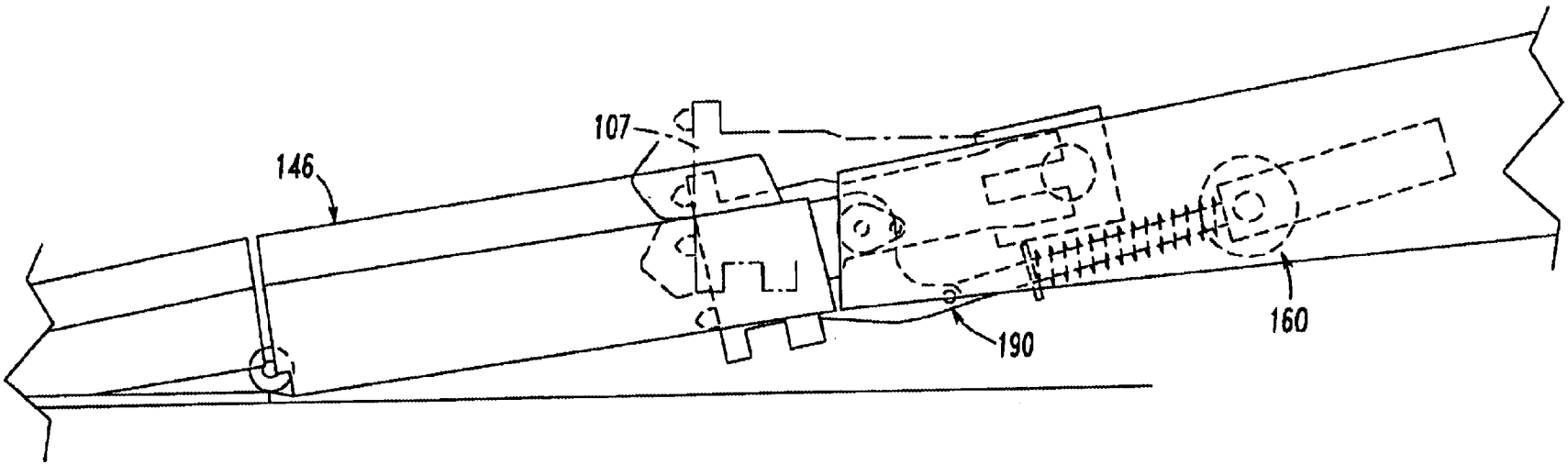
FIG. 32 is a more detailed view of the ramp attachment and coupler in FIG. 28.
Figure 33:
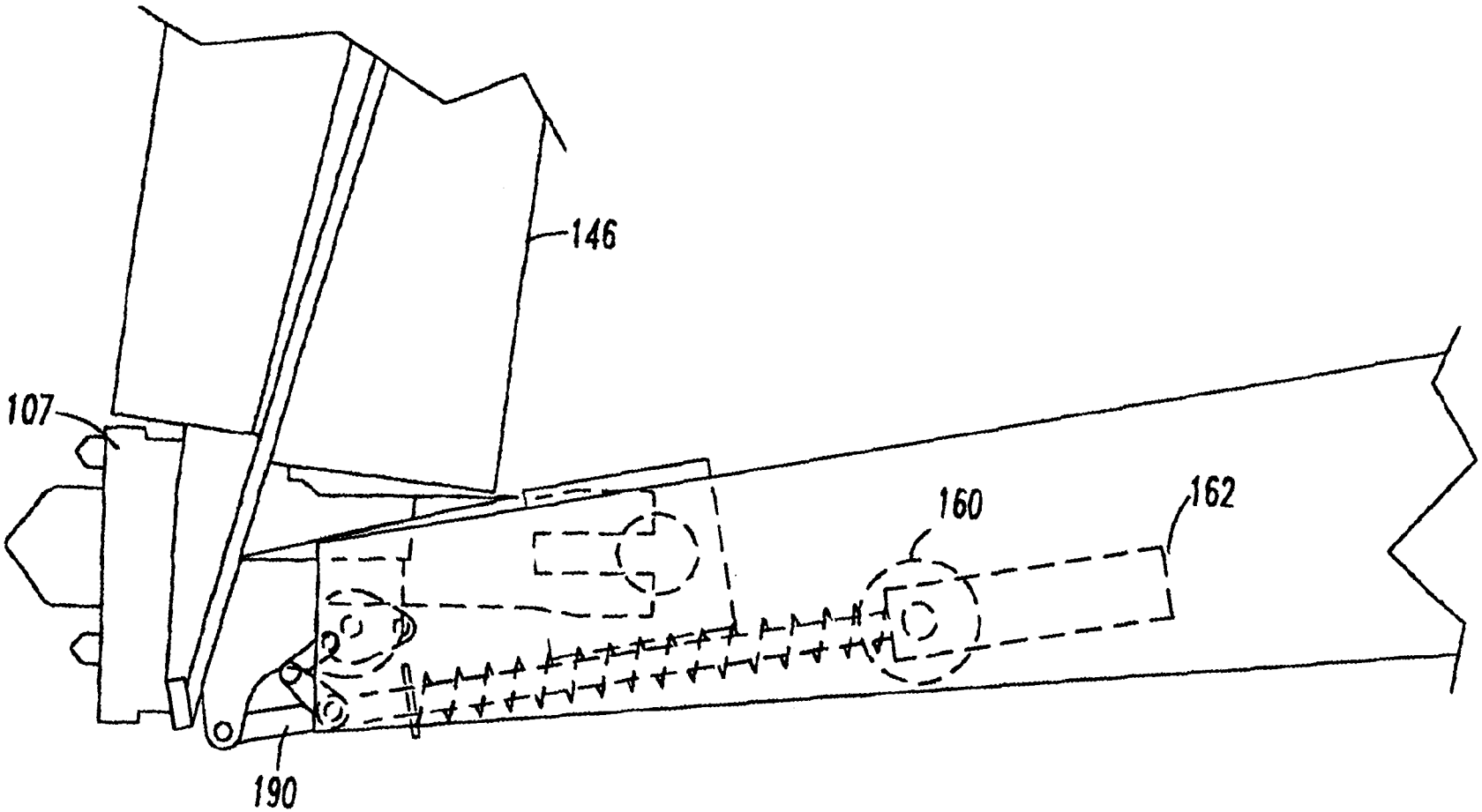
FIG. 33 is the same view as FIG. 32 except showing the ramp in a fully retracted position with the coupler extending beyond the end of the platform.

Another preferred embodiment of a ramp is a folding jointed ramp 146, as shown in FIGS. 28–31. The same types of couplers can be used as described above. Similarly, a transit type coupler 207, shown in FIGS. 32–33, is preferably used. Likewise, the spring tension device 160 is used to operate an evaluating mechanism 190 to control raising and lowering of the ramp 146.

Sub-Systems

Trailer Tie Down

Each of the three platform types 43, 44, 45 is equipped with two tractor operated pull-up hitches spaced 29 feet apart. This spacing permits loading of all platforms 43, 44, 45 with either two 28 foot "pup" trailers 83 or one 40–57 foot long single trailer 82 to be carried between two trucks. If desirable, a 28 foot pup can also be loaded and be followed by a long trailer 82 spanning the articulated joint between two platforms. The hitch 80 used is modified to increase its width at the vertical strut base, which is necessary to control trailer roll in the non-AAR trailers which are to be carried. Since the segment 40 will never be humped, the normal cast top plate can be eliminated and a lower weight pressed steel design used. Finally, the hostler tractor should be equipped with closed circuit television in order to both improve safety and decrease loading time over systems which depend on communication between a ground man and driver. Another feature proposed for the loading system is an electric hitch lock monitor which can be implemented to indicate proper locking of both the kingpin into the top plate, and of the diagonal strut into the raised position. A hydraulic cushioning system is also proposed both to reduce noise and improve hitch system life as compared to non-cushioned hitches.

Braking

Figure 34:
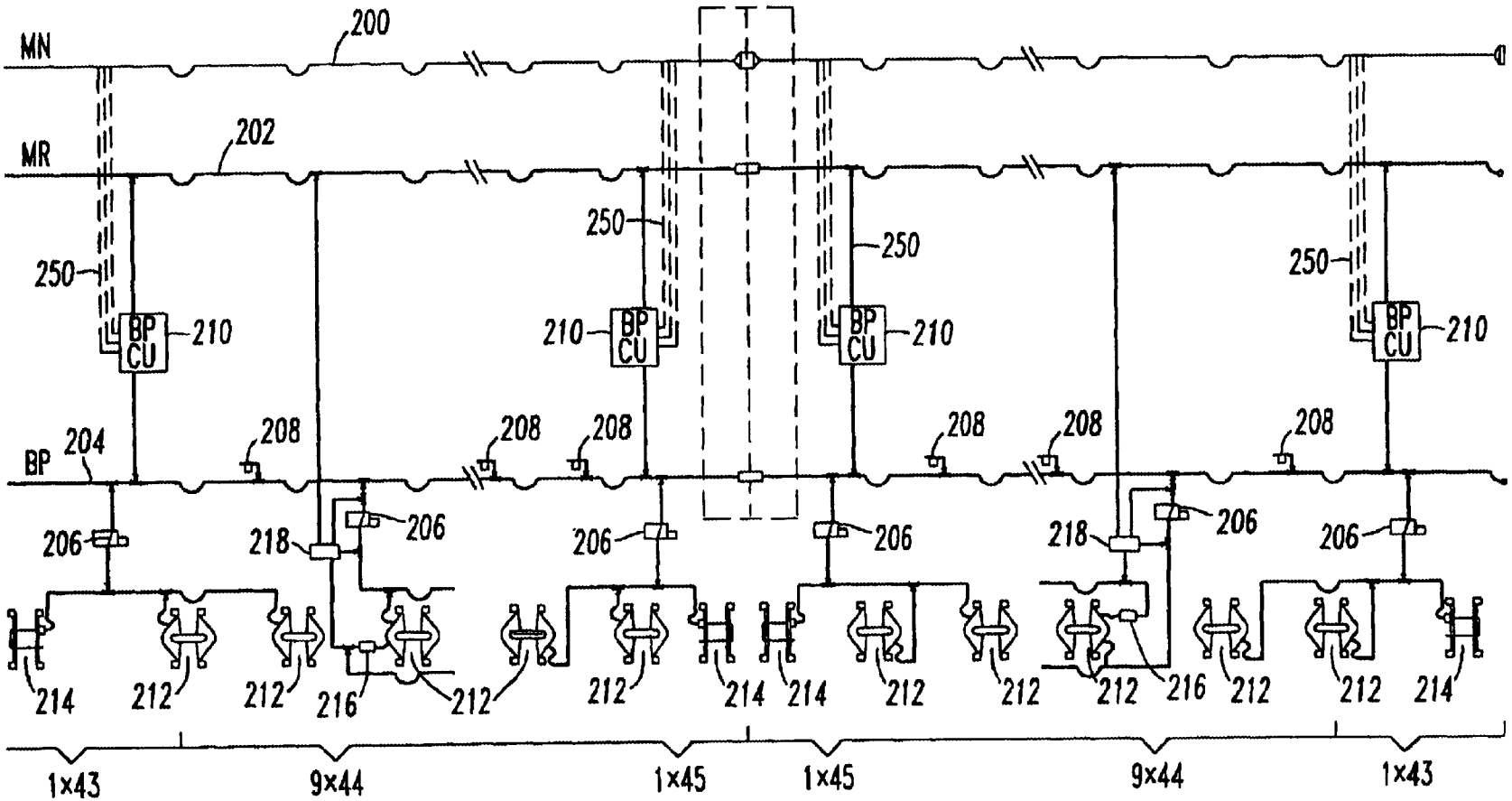
FIG. 34 is a schematic of a preferred embodiment of a brake system for an intermodal train.

The braking system, shown schematically in FIG. 34 may be the most important of the sub-systems. The basic system is a two-pipe (main reservoir pipe 202 and brake pipe 204) graduated release design in which cylinder pressure is developed in response to brake pipe 204 pressure reduction and graduated off as this pressure is restored. It preferably uses one modified ABDX control valve 206 to supply brake cylinder pressure for each three trucks. The control valves 206 are mounted to the first intermediate platform, third intermediate, sixth and every third platform thereafter. Every platform not equipped with a control valve 206 has a No. 8 vent valve 208 to aid in emergency brake transmission. In addition, the adapter 43 and ramp 45 platforms each carry an electro-pneumatic brake pipe control unit (BPCU) 210 which will be further described.

The use of a second pipe, namely the main reservoir pipe 202, serves three purposes. The first is to permit a trailing locomotive in a long train to provide or receive air from a remote locomotive or control cab at, say, the head of the train, thus enabling double ended operation with power on only one end of the train. The second is to eliminate taper from the brake pipe 204 and speed its response during pressure increases. Finally, the main reservoir pipe 202 can be used to supply air for the release of the spring applied parking brake 212 on those trucks which are so equipped.

Brake Pipe Control

The BPCU 210 on the adapter 43 and ramp 45 platforms of each segment include a pair of magnet valves arranged to be operated by trainline wires, which can be in the locomotive MU cable 200, in concert with the engineer's brake valve, from a CS-1 brake pipe interface unit on the locomotive as will be further discussed in the Locomotive Sub-Systems section of this description. When brake pipe 204 pressure reduction is called for on the locomotive, the application magnet valves on each BPCU 210 in the train will vent pressure locally causing rapid reduction to the pressure set by the brake valve at each point where a BPCU 210 is installed, thus instantaneously applying brakes throughout the train and reducing both in train forces and stop distance. When brake pipe 204 command is satisfied, valves at each BPCU 210 will be de-energized and no brake pipe 204 pressure change will occur.

In like manner, when the engineer changes the brake valve setting to increase brake pipe 204 pressure, the locomotive CS-1 interface will energize supply magnet valves at each BPCU 210. The supply of air to the BPCU 210 comes from the main reservoir equalizing pipe 202, so the brake pipe 204 is rapidly and equally recharged at both ends of each segment in a train, and no taper will exist. This electro-pneumatic brake pipe control will be very effective on trains made up of multiple segments, and since only 4 control valves 206 are required for an 11 platform segment, slight additional cost of the extra pipe 202 and two BPCUs 210 are offset by the reduction in the number of control valves along with greatly improved performance provided.

Other important parts of the brake system are the foundation brake rigging, which is a TMX truck mounted brake 212 on all trucks except the 28 inch truck of the loader which is equipped with a simple WABCOPAC II truck mounted brake 214. The TMX 212 is a special design producing high brake shoe force and a high braking ratio for the train.

Spring Applied Parking Brake

Figure 35:
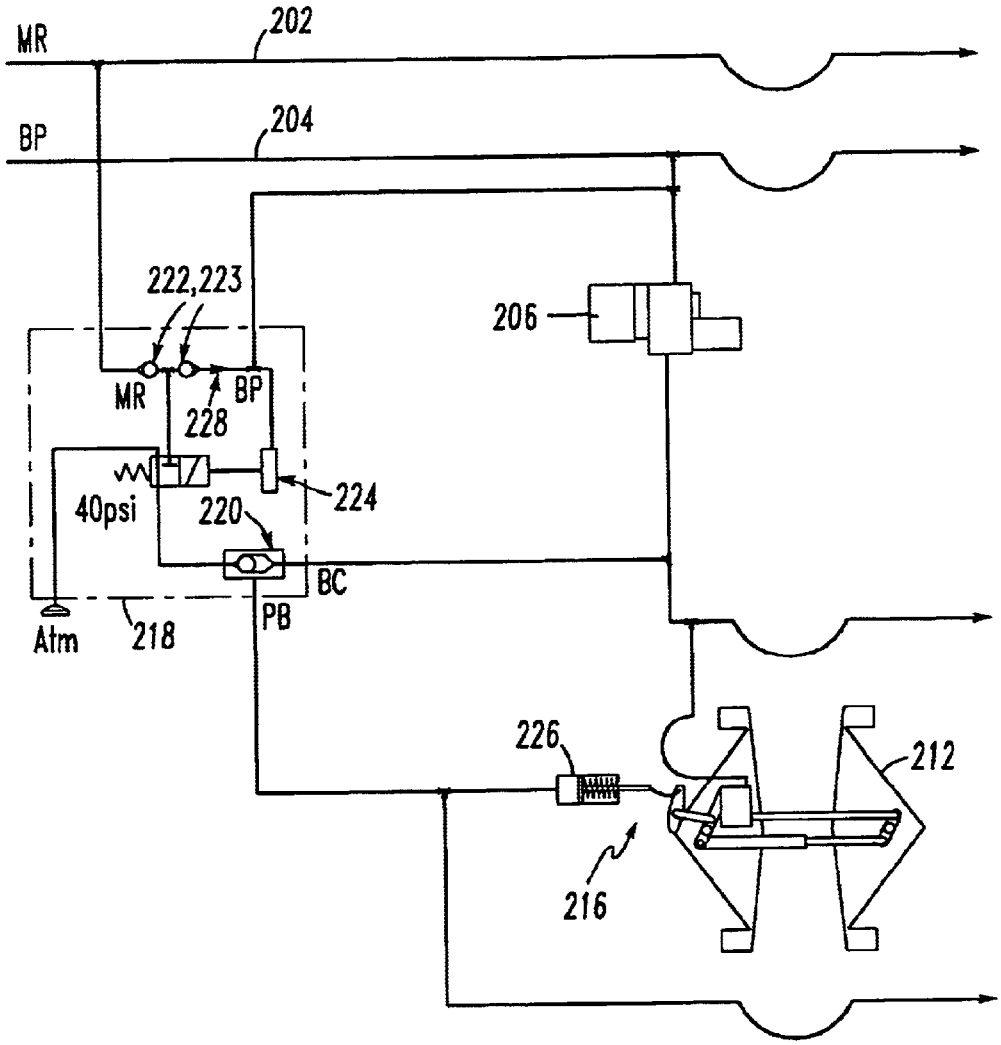
FIG. 35 is a schematic diagram of a preferred embodiment of a spring applied parking brake control.
Figure 37A:
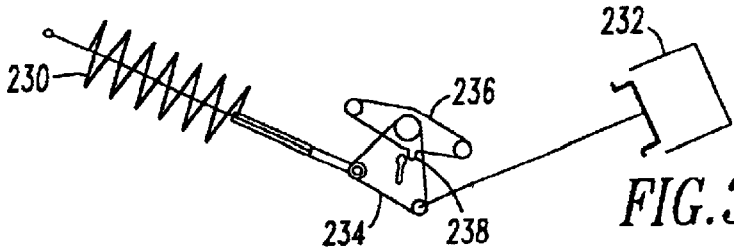
FIG. 37*a*–37*e* are position diagrams showing the operation of the spring applied air brake shown in FIGS. 34 and 35.
Figure 37B:
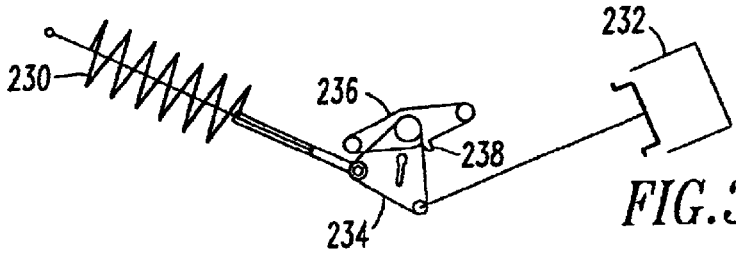
Figure 37C:
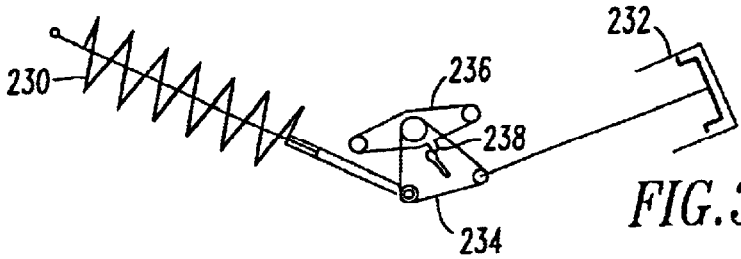
Figure 37D:
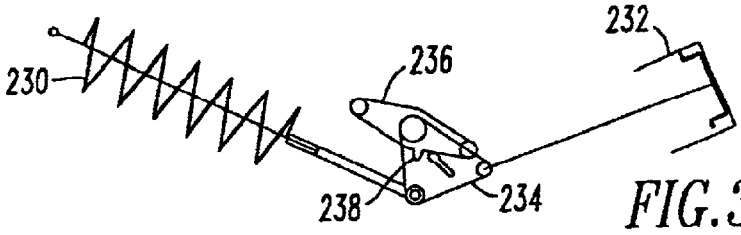
Figure 37E:
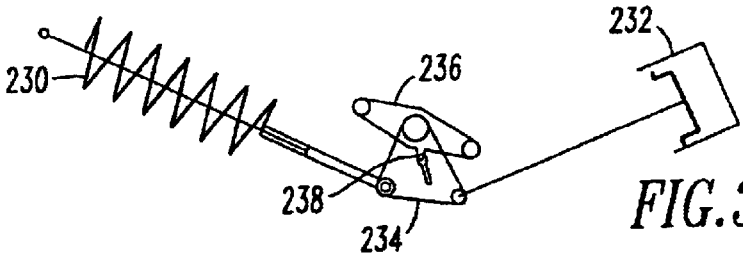
Figure 38C:
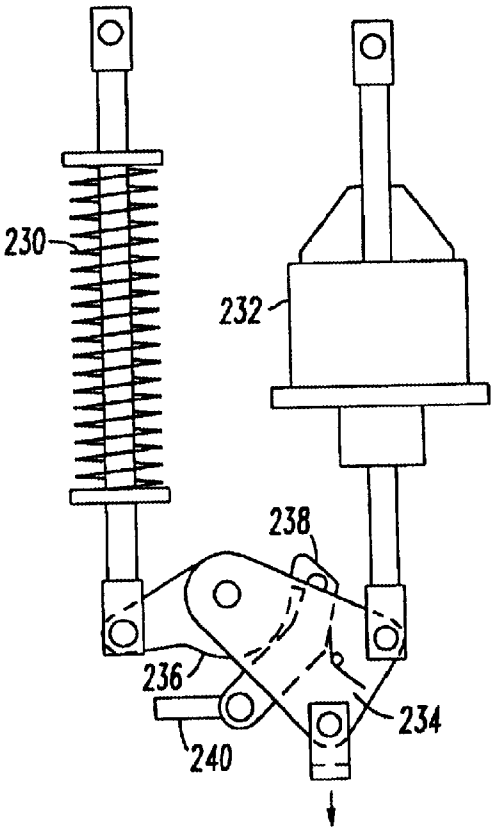
FIGS. 38*a*–38*c* are more detailed, side views, of the operating positions of the spring applied parking brake.
Figure 38B:
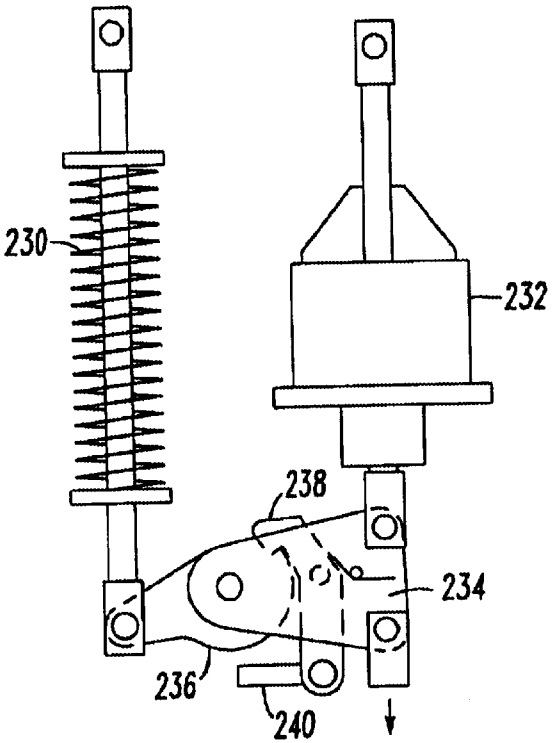
Figure 38A:
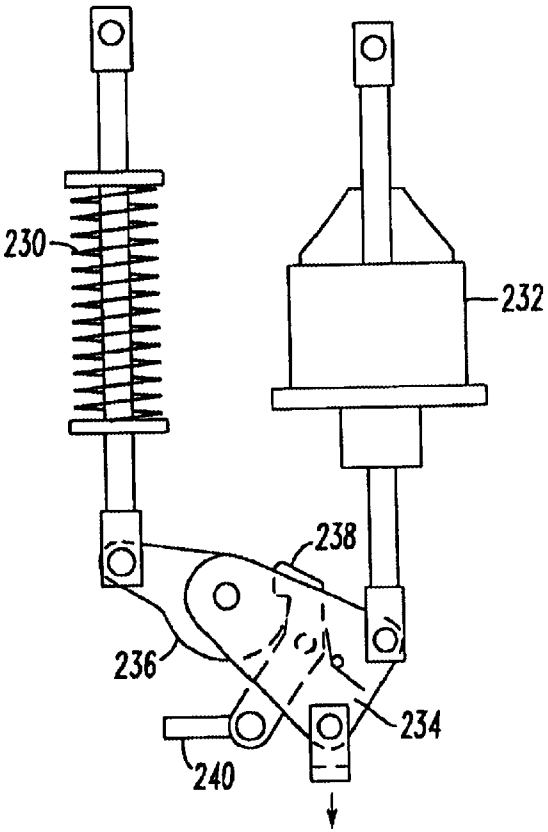
Figure 39:
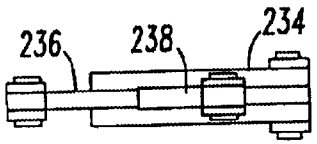
FIG. 39 is an end view of the spring applied brake shown in FIG. 37*b*.

In addition to the simple electro-pneumatic brake pipe control system, a spring applied parking brake 216, as shown best in FIGS. 35–39, can be provided on the fourth fifth and sixth trucks (counting 1 as the 28 inch truck 48 under the adapter platform 43). This parking brake 216 is under the control of a parking brake control valve 218 as shown in FIG. 35, and will be released by the presence of brake pipe pressure above 70 psi.

Parking Brake Control

The parking brake control valve 218 will not, however allow application of the parking brake 216 until brake pipe 204 pressure is reduced below 40 psi nominal, and even then, parking brake 216 operation will be inhibited to the extent that brake cylinder pressure is present by the spring brake double check in the pilot valve 220. This is achieved through the several parts of the parking brake control valve 218 as further described below.

Charging—Normal Operation

During initial charging of the train under normal conditions, the main reservoir pipe 202 pressure will rise quickly to a relatively high value. Further, since all air being supplied to the BP 204 comes from main reservoir, this value will always be higher than brake pipe pressure. Thus air will flow into the parking brake control valve 218 through its MR port, pass through the charging check valve 222, and hold the charging check valve 223 from the brake pipe connection to its seat thus preventing any flow of air from BP 204 into the system and maintaining the BP 204 response as rapid as possible. Since initially the BP 204 will be below 40 psi nominal, the operating valve 224 will be in its application position as shown, such that further flow of air will take place and the parking brake 216 will remain applied. Once brake pipe pressure rises to a value in excess of 40 psi nominal, the operating valve 224 will switch over, and connect the charging check valve 222 output to the spring brake release cylinder 226 via the parking brake interlock double check valve 220, compressing the spring and relieving spring force on the brake shoes of all trucks under the control of the parking brake release valve 218. As train charging continues, the pressure in the spring brake release cylinders 226 will rise to the value of the MR pipe 202.

Charging—Towing Operation

There will be occasions when it will be desirable to tow the intermodal train segments 40 in a conventional train where no MR pipe 202 is available, and the spring applied parking brake 216 will not interfere with this operation. In such a case there is no pressure in the MR pipe 202, and as BP 204 is charged, air will flow through the flow control choke 228 and the BP side charging check 223, holding the MR side charging check 222 to its seat and preventing loss of BP 204 air to the non-pressurized MR pipe 202. Air will then flow to the spool of the operating valve 224 where it will initially be stopped by the fact that the spool does not shift until brake pipe pressure has risen above 40 psi nominal as before. Once brake pipe pressure rises above this level, the operating valve 224 spool will shift (to the left in FIG. 35) connecting brake pipe pressure to the spring brake release cylinders 226 as before. Note however that in this case the air for spring brake release is supplied by the flow control choke 228, whose size has been chosen to prevent the opening of the operating valve 224 spool to the empty spring brake release cylinders 226 from causing any significant drop in brake pipe pressure which might otherwise either cause unstable operation of the operating valve 224, or even but the train brakes into emergency.

Parking Brake Operation During Service Brake Application & Release

When brake pipe pressure is reduced to cause a normal service application of train brakes, the pressure after the reduction will always be greater than 40 psi, and the operating valve 224 will remain in its normal released position (spool shifted to the left in the diagram). The brake pipe side charging check 223 will remain on its seat and no air will flow to BP 204 from the parking brake system 216, 218. The ABDX control valve 206 will supply air to its brake cylinder port, however and this will flow to the brake cylinders in the normal way. This pressure will also enter the parking brake control valve 218 at the brake cylinder port and pressurize the right hand side of the parking brake interlock double check 220, which is held to the right hand seat by the air already present in the fully charged spring brake release cylinder 226. Thus neither BP 204 nor brake cylinder operation is affected in the slightest way by the presence of the spring applied parking brake system 216, 218.

When release of the service brake is commanded, brake pipe pressure will rise as commanded, but no parts of the parking brake control valve 218 will be affected. When the brake cylinder pressure is released pressure on the right hand side of the interlock double check valve 220 will be reduced but, as this valve 222 remains against its right hand seat at all times in normal braking, there is again no operational difference in the brake equipment as a result of the spring applied parking brake 216.

Parking Brake Operation During Emergency Brake Application & Release

When brakes are applied in emergency, the brake pipe pressure is quickly reduced to zero and the ABDX valve 206 reacts by providing maximum brake cylinder pressure, which must always be about 5 psi lower than the fully charged value that the BP 204 had been. Since the brake pipe pressure is necessarily lower than the 40 psi nominal switch pressure of the operating valve 224, the operating valve 224 device will move to the application position and connect the left hand side of the interlock double check valve 220 to atmosphere and attempt to vent the spring brake release cylinders 226, thus applying the spring brake 216 on top of the normal pneumatic brake which is very undesirable as it could cause slid flats and wheel damage. This circumstance is prevented, however because brake cylinder pressure from the control valve 206 builds up on the right hand port of the interlock valve 220 more quickly than it drops off on the left side, shifting the double check 220 and preventing pressure from being vented by the spring brake cylinder 226. Thus, the excessive brake buildup mentioned above is prevented. As brake cylinder pressure dissipates after the emergency due, for example, to system leakage, the pressure on the right hand side of the interlock valve 220 will reduce with it, and the spring brake 216 will apply as brake cylinder pneumatic force is lost thus guaranteeing that the train will be held in place until brake pipe pressure is restored. In the event that it is desired to manually release the parking brake 216 without air, means are included in the mechanism of the spring brake 216 itself to provide this feature.

Spring Brake Operation

In operation, the spring pack 230, as shown best in FIGS. 36*a*–37*e*, is attempting to force the bellcrank 234 to rotate the transfer lever 236 and apply the spring brake 216, while the spring brake release cylinder 232 overcomes this tendency and maintains the bellcrank 234 rotated against its stop, in which position it remains, with no interference with the transfer lever's 236 normal operation, as shown most clearly in the position diagrams of FIGS. 37*a*–37*e*. The spring brake double check 220, as already mentioned, provides an interlock to prevent applying the spring brake 216 on top of service brake in an emergency or breakdown situation. FIG. 37*a*–37*e* also shows, in principle, the method by which the spring applied parking brake 216 may be manually released. It can be seen in those figures that the bellcrank 234 carries a pawl 238 which normally engages the transfer lever 236 of the TMX system and will force this lever 236 to rotate and apply brakes when the air is vented from the spring brake cylinder 232. Referring to more detailed drawings of the spring applied parking brake 216 in FIGS. 38*a*–39, the pawl 238 is arranged with an operating shaft 240 extending to a convenient point on the side of the truck. The operating shaft 240 may be pulled with a simple lever carried by the car man or maintenance personnel and when this is done the connection between the spring 230 and transfer lever 236 will be lost, and the spring 230 will bottom out the release cylinder 232, while the brake shoes will be pulled away from the wheels by the normal release spring in the TMX brake cylinder.

Health Monitoring

There are only two train borne defects which can lead to derailment; overheated wheels, which may break, and overheated journal bearings which may either seize or burn off. The primary purpose of the health monitoring system is to prevent these two serious defects and their consequences. The system can communicate system status to the train crew by either illuminating defect indicator lights at the appropriate location of the defect, or via electronic communication to a display in the operating cab, depending on railroad preferences. The conditions monitored are the temperatures of all bearings, and whether brakes are dragging. In checking bearing temperature for potential failure, enough electronic logic is provided to sense both rate of temperature rise, temperature differences within a truck, and excedence of a predetermined maximum temperature by any bearing. The system's logic will also detect a faulty sensor, and signal this defect in a different manner than is used for an actual equipment defect. This could be a light of a different color or a specific electronic message.

Sticking brakes are monitored by detecting the position of the brake cylinder on each truck with a proximity switch, so that should dragging brakes occur, this will be immediately indicated by signaling the fact that one or more brake cylinders are not in release position when they should be. If desired, a pressure switch could also be added at each control valve, set to determine the fact that at least fifty percent of a full service brake application was in effect. This would permit monitoring both the fact that the brakes are not released (stuck "off") and that pressure sufficient to cause effective brake application is being supplied. This logic could be used to indicate that brakes properly apply and release on each car, within the meaning of the power brake law for initial terminal inspection.

Locomotive Interface Unit

One of the difficulties in constructing an integral train, is how to apply a standard locomotive with its limited connections to the train (usually only the brake pipe pneumatic interface) to convey and receive the somewhat greater amounts of information required by a health monitoring system and electronically assisted brake system.

Figure 40:
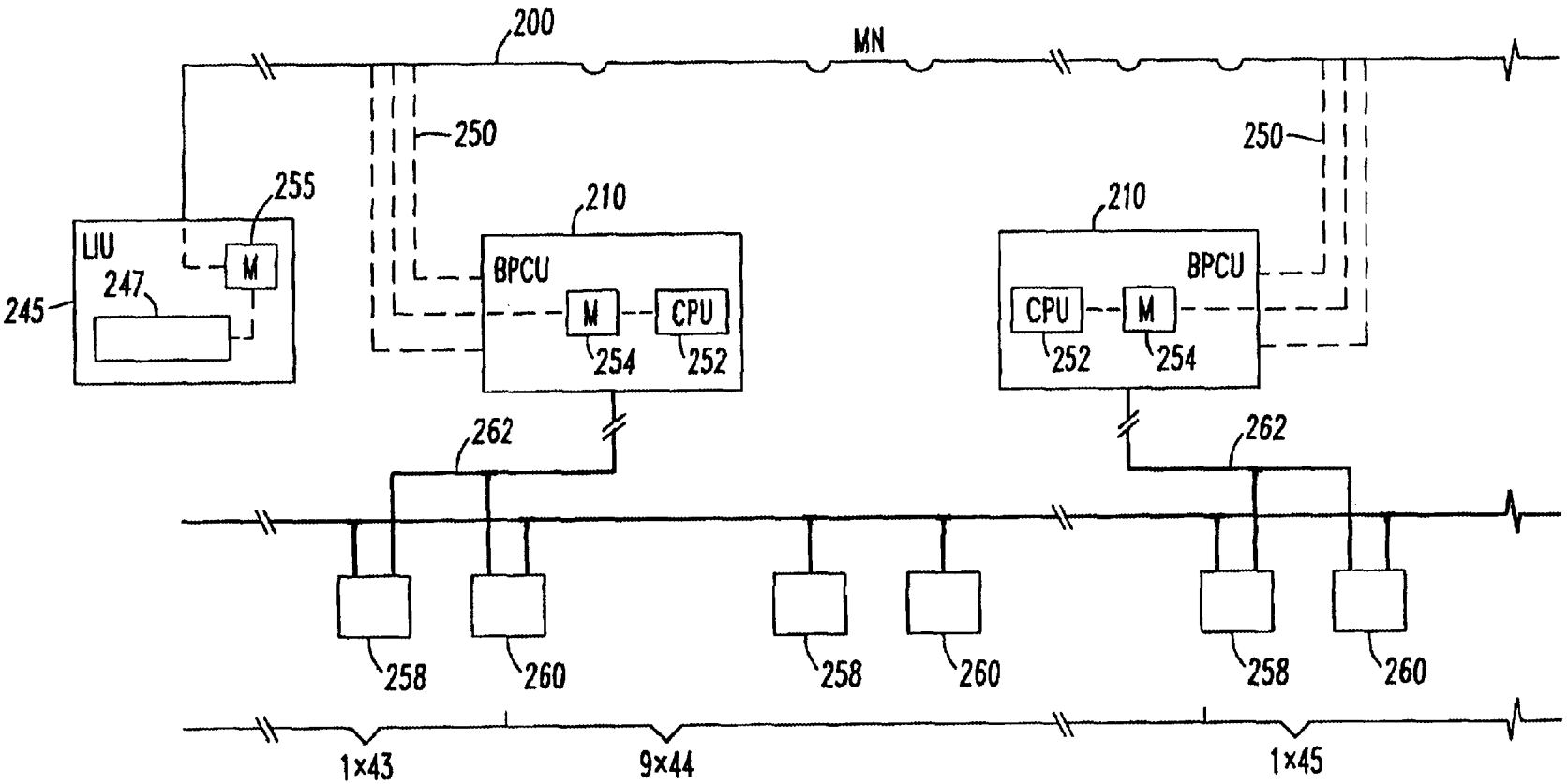
FIG. 40 is a schematic diagram similar to FIG. 34 but showing a preferred embodiment of an electrical communication scheme for a train health monitoring system.

Referring to the simplified schematic in FIG. 40, the intermodal train solution to this problem is to provide the ramp 45 and adapter 43 platforms of each segment 40 with a small computer 252 and modem 254 mounted in the BPCU 210, operating at relatively low frequency over the brake application and release wires, which are located within the MU cable 200, and to provide trainline wire connections from the locomotive into the nearest of these computers. Since the commands to the brake system are made only at the end platforms in any case, only the health monitoring system need use electronic communications. Thus, a simple single wire 256 (plus ground wire) communication system to the health monitoring node on each platform should be all that is necessary to take the information from all 11 platforms 43, 44, 45 of a segment 40 into the small computers 252 at the two segment ends. From these ends, connections to a locomotive or control cab can be made by simply plugging a jumper cable 250 into the locomotive 27 MU cable 200 using the positive and negative wires on the conventional 72 VDC locomotive battery as a power source, and communicating into the locomotive over whatever spare trainline wires might be designated by the individual railroad.

It's assumed that digital communication into a single wire would be through modem 255, which would be part of the stand-alone locomotive interface unit (LIU) 245 in the cab of the locomotive. The LIU 245 would include a display 247 and connections to the gage test fittings for the equalizing reservoir and brake pipe gages of the locomotive's control console. As the differential between brake pipe and equalizing reservoir determines whether the application magnet, release magnet or no magnet should be energized by the BPCU 210 on each segment 40, this provides all of the information and communications capability that should be necessary. It also makes the equipping of any locomotive for service on an intermodal train an operation of but a few minutes, requiring no more skill than is required to plug in a box and connect two small pneumatic tubes to the gage test fittings (which are already there) for this type connection. In the event that the locomotive brake valve is not equipped for graduated release, this feature could easily be added to the 26 brake valve.

The communication between the LIU 245 and the intermediate train segments 40 would be by digital communication over trainline wires in the MU cable 200 from the LIU 245 to the BPCU 210 on the segment end adjacent the locomotive, then from one BPCU 210 to the other BCPU 210 on that segment. As described above, individual wheel bearing temperature sensors 258 and brake cylinder position sensors 260 can be provided on each truck to detect the requisite information for the small computers 252 in the BPCUs 210. The individual sensors 258, 260 would be cabled 262 to the BPCU 210 electronics separately, and this cable 262 preferably would not pass from segment to segment, or to the locomotive like the application and release wires. Since detachable plugs would only interrupt the communications wire between the locomotive and between the segments but not the sensor cabling 262, this path, with no more than 10 plugs, would be very low in resistance and would not require high voltage for reliable communications. The communications protocol should address each segment for monitoring purposes (brake control being a physical circuit) probably by a pre-assigned number or address. The BPCU 210 on each segment would have a memory to store that segments individual platforms, addresses current data. Thus, manually programming a locomotive interface unit 245 to communicate with a 110 platform intermodal train would only require the setting of 10 addresses which could be manually done or performed automatically on a daisy chain, front-to-rear basis.

A typical LIU 245 display screen 247 could simply indicate whether or not there were any exceptions to normal operation. If an exception exists, the operator could request further information. The screen 245 can also display the conditions of the brake monitoring system which in the absence of exception, shows the conditions as either low brake rate, released or applied. In the LIU 245 logic, (which has the equalizing reservoir and brake pipe pressure information) it will be a simple matter to determine the command status of the brakes. The logic would then report brake cylinders not released as "low rate braking" if a brake command was in effect, "brakes applied" if no brake was released and fifty percent pressure was in effect, and "brakes dragging" if a release was commanded and sufficient time had elapsed since the release command to cause all pistons to withdraw, but one or more had failed to do so. "Brakes released" would be reported when no pistons were out of release position.

When "brakes dragging" is reported on an alarm or exception basis, this indication would have to be acted upon in accordance with rules determined by the railroad. As this system requires very little in the way of sending the brake apply and release signals, and communication is only necessary on demand from the car borne electronics to the 11 platforms, it should not be necessary to require anything more substantial than a party-line telephone system from locomotive to individual segments, and with an automatic monitoring sub-system on each segment. Further, communications would always be initiated by the locomotive asking the segments one at a time if exceptions existed. Only if an exception was found would further inquiries be placed, thus communications could be at a low rate without sacrificing response time.

Although certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A platform of a train segment comprising:

a. a left side sill and a right side sill;

b. a wide box beam center sill;

c. support gussets connecting said left side sill and said right side sill to side wide box beam center sill such that vertical loads from said left and right side sills are transferred into said wide box beam center sill;

d. said wide box beam center sill having spaced apart sides, a top plate connecting said spaced apart sides and an open bottom along a middle portion thereof which supports said platform, said spaced apart sides having bottom flanges at said open bottom; and e. said gussets welded to the full height of said spaced apart sides from said left and right side sills.

2. The platform of claim 1 further comprising:

a. on at least one end of said platform being provided at least one of at least one bearing shoe adjacent each of said left and right side sills; and at least one bearing shelf adjacent each of said left and right side sills and extending beyond said platform; and b. at least one of said at least one bearing shoe and at least one bearing shelf cooperable with at least one of at least one bearing shelf and at least one bearing shoe, respectively, on an end of an adjacent platform to provide rock and roll stabilization therebetween.

3. The platform of claim 2 further comprising:

a. said at least one bearing shelf is a pair of bearing shelves, one of said pair connected to said left side sill and the other of said pair connected to said right side sill; and b. said at least one bearing shoe is a pair of bearing shoes, one of said pair connected to said left side sill and the other of said pair connected to said right side sill.

4. The platform of claim 2 further comprising:

a. said at least one bearing shoe provided on a first end of said platform;

b. said at least one bearing shelf provided extending beyond a second end of said platform;

c. said at least one bearing shoe cooperable with at least one bearing shelf on an end of a platform adjacent said first end to provide rock and roll stabilization therebetween; and d. said at least one bearing shelf cooperable with at least one bearing shoe on a platform adjacent said second end to provide rock and roll stabilization therebetween.

5. The platform of claim 1 further comprising:

a. a first end of said platform having a first slotted configuration;

b. a second end of said platform having a second slotted configuration; and c. said first and second slotted configurations matable in an interleaved relationship with second and first slotted configurations, respectively, on a platform adjacent said first and second ends, respectively, such that when a curved track section is traversed, adjacently connected platforms do not scrape against each other.

6. The platform of claim 1 further comprising:

a. a standard stub center sill on at least one end of said platform; and b. said wide box beam center sill spliced to said standard stub center sill.

7. The platform of claim 6 further comprising:

a. said wide box beam center sill sized to receive said standard stub center sill therein; and b. said standard stub center sill received and attached within said wide box beam center sill.

8. The platform of claim 1 further comprising a first articulated connector provided on at least one end of said platform.

9. The platform of claim 8 further comprising a second articulated connector provided at an end opposite said at least one end of said platform.

10. The platform of claim 1 further comprising a coupler provided on at least one end of said platform.

11. A platform of a train segment comprising:

a. on opposite ends of said platform there being provided, respectively, at least one bearing shoe adjacent each of each of left and right side sills of said platform; and at least one bearing shelf adjacent each of said left and right side sills and extending beyond said platform; and b. said at least one bearing shoe and at least one bearing shelf adapted to cooperate with at least one bearing shelf and at least one bearing shoe, respectively, on an end of a platform connectable adjacent thereto to provide rock and roll stabilization therebetween.

12. The platform of claim 11 further comprising:

a. said at least one bearing shelf is a pair of bearing shelves, one of said pair connected to said left side sill and the other of said pair connected to said right side sill; and b. said at least one bearing shoe is a pair of bearing shoes, one of said pair connected to said left side sill and the other of said pair connected to said right side sill.

13. The platform of claim 11 further comprising:

a. a first end of said platform having a first slotted configuration;

b. a second end of said platform having a second slotted configuration;

c. said first and second slotted configurations matable in an interleaved relationship with second and first slotted configurations, respectively on a platform adjacent said first and second ends, respectively such that when a curved track section is traversed adjacently connected platforms do not scrape against each other.

14. The platform of claim 11 further comprising:

a. said at least one bearing shoe provided at a first end of said platform;

b. said at least one bearing shelf provided extending beyond a second end of said platform; and c. said at least one bearing shoe cooperable with at least one bearing shelf on an end of a platform adjacent said first end to provide rock and roll stabilization therebetween; and d. said at least one bearing shelf cooperable with at least one bearing shoe on a platform adjacent said second end to provide rock and roll stabilization therebetween.

15. The platform of claim 11 further comprising a first articulated connector provided on at least one end of said platform.

16. The platform of claim 15 further comprising a second articulated connector provided at an end opposite said at least one end of said platform.

17. The platform of claim 11 further comprising a coupler provided on at least one end of said platform.

18. A platform of a train segment comprising:

a. a first slotted configuration on a first end of said platform;

b. a second slotted configuration on a second end of said platform;

c. said first slotted configuration matable in an interleaved relationship with said second slotted configuration on a second end of an adjacent platform such that when a curved track section is traversed adjacently connected platforms do not scrape against each other;

d. said second slotted configuration matable in an interleaved relationship with a first slotted configuration on a first end of an adjacent platform such that when a curved track section is traversed adjacently connected platforms do not scrape against each other and e. wherein said first and second ends of said platform are each supportable by a truck, and each of said first and second ends extend over top of said truck when supported thereby such that when said first and second ends of said platform are coupled adjacent to said matable second and first ends of adjacent platforms, mating ends of said adjacent platforms bridge said truck.

19. The platform of claim 18 further comprising a first articulated connector provided on at least one end of said platform.

20. The platform of claim 19 further comprising a second articulated connector provided at an end opposite said at least one end of said platform.

21. The platform of claim 18 further comprising a coupler provided on at least one end of said platform.

22. A platform of a train segment comprising:

a. a wide box beam center sill;

b. a left side sill and a right side sill;

c. support gussets connected from said left and right side sills to said wide box beam center sill such that vertical loads from said left and right side sills are transferred into said wide box beam center sill;

d. a ramp connected to an end of said platform, said ramp movable between a stored position and a loading position, said loading position providing access from ground level to said platform such that objects may be easily transported onto and off from said platform via said ramp;

e. said wide box beam center sill having spaced apart sides, a top plate connecting said spaced apart sides, and an open bottom, said spaced apart sides having bottom flanges at said open bottom; and f. said gussets welded to the full height of said spaced apart sides from said left and right side sills.

23. The platform of claim 22 wherein said end of said platform having said ramp further comprises at least one downwardly sloped portion, and said ramp connected to said at least one sloped portion.

24. The platform of claim 22 further comprising a ramp positioning device, said ramp movable between said stored position and said loading position by said positioning device, said positioning device connected to at least one of said ramp and said platform.

25. The platform of claim 22 further comprising:

a. a standard stub center sill at an end of said platform having said ramp;

b. said wide box beam center sill sized to receive said standard stub center sill therein; and c. said standard stub center sill received and attached within said wide box beam center sill.

26. The platform of claim 22 further comprising:

a. at least one bearing shoe at an end of said platform opposite said end having said ramp; and b. said at least one bearing shoe cooperable with at least one bearing shelf on a platform connected adjacent said end having said at least one bearing shoe to provide rock and roll stabilization therebetween.

27. The platform of claim 26 further comprising:

a. said at least one bearing shoe is a pair of bearing shoes, one of said pair connected to said left side sill and the other of said pair connected to said right side sill; and b. each of said pair of bearing shoes cooperable with a respective bearing shelf connected to each of left and right side sills of said adjacently connected platform.

28. The platform of claim 22 further comprising said platform having a first slotted configuration at said an end of said platform opposite said end having said ramp, said first slotted configuration matable in an interleaved relationship with a second slotted configuration on a platform connected adjacent said end having said first slotted configuration such that when said adjacently connected platforms traverse a curved track section said interleaved platforms do not scrape against each other.

29. The platform of claim 22 further comprising a first truck at said end having said ramp, and wherein said first truck is a 28 inch wheel truck.

30. The platform of claim 22 further comprising an articulated connector provided on an end of said platform opposite said end having said ramp connected thereto.

31. The platform of claim 22 further comprising a coupler provided on said and of said platform having said ramp connected thereto.

32. A platform of a train segment comprising:

a. at least one bearing shoe on at least one end of said platform, said at least one bearing shoe cooperable with at least one bearing shelf at an end of a platform connected adjacent said at least one end to provide rock and roll stabilization therebetween;

b. a ramp portion at an end of said platform opposite said at least one end, said ramp portion movable between a stored position and a loading position, said loading position providing access from ground level to said platform such that objects may be easily transported onto and off from said platform via said ramp;

c. said platform having a left side sill and a right side sill;

d. said at least one bearing shoe is a pair of bearing shoes, one of said pair connected to said left side sill and the other of said pair connected to said right side sill; and e. each of said pair of bearing shoes cooperable with a respective bearing shelf connected to each of left and right side sills of said adjacently connected platform.

33. The platform of claim 32 further comprising said platform having a first slotted configuration at said at least one end, said first slotted configuration matable in an interleaved relationship with a second slotted configuration on a platform connected adjacent said at least one end such that when said adjacently connected platforms traverse a curved track section said interleaved platforms do not scrape against each other.

34. The platform of claim 32 further comprising an articulated connector provided on an end of said platform opposite said end having said ramp connected thereto.

35. The platform of claim 32 further comprising a coupler provided on said end of said platform having said ramp connected thereto.

36. A platform of a train segment comprising:

a. a first slotted configuration on at least one end of said platform, said first slotted configuration matable in an interleaved relationship with a second slotted configuration on a platform connected adjacent said at least one end such that when said adjacently connected platforms traverse a curved track section said interleaved platforms do not scrape against each other;

b. said at least one end of said platform supportable by a truck and extends over top of said truck when supported thereby, such that when first slotted configuration mates with said second slotted configuration mating ends of the adjacent platforms bridge said truck; and c. a ramp portion at an end opposite said at least one end, said ramp portion movable between a stored position and a loading position, said loading position providing access from ground level to said platform such that objects may be easily transported onto and off from said platform via said ramp.

37. The platform of claim 36 further comprising a first articulated connector provided on an end of said platform opposite said end having said ramp connected thereto.

38. The platform of claim 36 further comprising a coupler provided on said end of said platform having said ramp connected thereto.

39. A train segment comprising:

a. a plurality of platforms;

b. a first one of said plurality of platforms having a coupler and a first truck on at least one end thereof;

c. a last one of said plurality of platforms having at least one downwardly sloped portion and a second truck on at least one end thereof, and a ramp portion having a first end connected adjacent a distal end of said sloped portion and a second end, said ramp portion movable between a stored position and a loading position at which said second end extends substantially to ground level; and d. at least one of said plurality of platforms having a third truck on at least one end thereof and being connected intermediate said first and last ones of said plurality of platforms.

40. The train segment of claim 39 further comprising said at least one platform connected intermediate said first and last platforms is a plurality of intermediate platforms each having an articulated connector on opposite ends thereof, and each of said first and last ones of said plurality of platforms having an articulated coupler on at least one end thereof for connecting to said articulated connector on one of said opposite ends of respective ones of said plurality of intermediate platforms.

41. The train segment of claim 39 further comprising said last one of said plurality of platforms having a coupler at said at said end having said at least one sloping portion, said coupler caused to be raised when said ramp is raised and caused to be lowered when said ramp is lowered.

42. The train segment of claim 39 further comprising said first one of said plurality of platforms having a fourth truck on an end opposite said first truck.

43. The train segment of claim 39 wherein said first and second trucks further comprise 28 inch wheel trucks.

44. The train segment of claim 43 wherein said third and fourth trucks further comprise 33 inch wheel trucks.

45. The train segment of claim 39 wherein said at least one of said plurality of platforms further comprise:

a. a left side sill and a right side sill;

b. a wide box beam center sill;

c. support gussets connecting said left side sill and said right side sill to side wide box beam center sill such that vertical loads from said left and right side sills is transferred into said wide box beam center sill;

d. said wide box beam center sill having spaced apart sides, a top plate connecting said spaced apart sides and an open bottom along a middle portion thereof which supports said platform, said spaced apart sides having bottom flanges at said open bottom; and e. said gussets welded to the full height of said light weight webs from said left and right side sills to side wide box beam center sill.

46. The train segment of claim 45 further comprising at least one of said plurality of platforms having a standard stub center sill spliced to said wide box beam center sill.

47. The train segment of claim 46 further comprising:

a. said wide box beam center sill sized to receive said standard stub center sill therein; and b. said standard stub center sill received and attached within said wide box beam center sill.

48. The train segment of claim 39 further comprising at least one end of at least two adjacently connected ones of said plurality of platforms having a pair of bearing shoes on one of said adjacently connected platform cooperating with a pair of bearing shelves on the other of said adjacent connected platforms, said pair of bearing shelves and said pair of bearing shoes provided adjacent to left and right side sills of each of said adjacently connected platforms.

49. The train segment of claim 39 further comprising adjacent ends of at least two adjacently connected ones of said plurality of platforms having respective first and second slotted configurations, said adjacent ends bridging a truck supporting said adjacent ends, said first and second slotted configurations matable in an interleaved relationship such that when said adjacently connected platforms traverse a curved track section said interleaved platforms do not scrape against each other.

50. A platform for a train segment comprising:

a. at least one downwardly sloping portion; and b. a ramp connected to said platform at said at least one downwardly sloping portion, said ramp having a first end movably connected adjacent a distal end of said downwardly sloping portion, said ramp having a second end movable between a raised position and a lowered position at which said second end extends substantially to ground level.

51. The platform of claim 50 further comprising a coupler at said end having said at least one downwardly sloping portion, said coupler movable between raised and lowered positions.

52. The platform of claim 50 further comprising a ramp actuator cooperable with said ramp and said platform to selectively move said ramp between said raised and lowered portions.

53. An apparatus for facilitating the loading and unloading of a rail vehicle, said rail vehicle having a coupler movably connected to an end thereof, said apparatus comprising:

a. a ramp having a first end movably connected to said end of said rail vehicle said ramp movable between a raised position and a lowered position at which an end of said ramp extends substantially to ground level;

b. a ramp actuator supported by said end of said rail vehicle;

c. said ramp actuator cooperable with said ramp to selectively raise and lower said ramp by causing said ramp to move about said movably connected first end; and d. wherein said coupler is caused to be lowered when said ramp is lowered and caused to be raised when said ramp is raised.

54. The apparatus of claim 53 wherein said ramp further comprises:

a. an elongated ramp body having a loading end opposite a pivotably connected end;

b. said elongated ramp body having at least two segmented portions, said pivotably connected end being part of a first segment and said loading end being part of a second segment; and c. said at least two segmented portions being pivotably joined together such that said first and second segments fold adjacent each other when said ramp is raised.

55. The apparatus of claim 53 wherein said ramp actuator further comprises a tensioning member supported by said end of said rail vehicle, said tensioning member engageable with said first end of said ramp to selectively raise and lower said ramp by causing said ramp to pivot relative to said end of said rail vehicle.

56. The apparatus of claim 55 wherein said ramp actuator further comprises:

a. a first linkage having one end engageable with said tensioning member and a second end engageable with said first end of said ramp; and b. said tensioning member operating said first linkage to raise and lower said ramp.

57. The apparatus of claim 56 wherein said tensioning member further comprises:

a. a spring tension member; and b. a fluid pressure activated member in communication with a source of pressurized fluid, said fluid pressure activated member cooperable with said spring tension member, said fluid pressure activated member controllable to raise and lower said ramp.

58. The apparatus of claim 57 wherein said source of fluid pressure comprises a pressurized reservoir on said rail vehicle chargeable from at least a main reservoir equalizing pipe on said rail vehicle.

59. The apparatus of claim 54 wherein said ramp actuator further comprises an elevating member supported by said end of said rail vehicle, said elevating member engageable with said coupler such that raising said ramp causes said elevating member to lower said coupler and lowering said ramp causes said elevating member to elevate said coupler.

60. The apparatus of claim 59 wherein said ramp actuator further comprises a second linkage having one end engageable with said coupler and a second end engageable with said tensioning member such that said second linkage causes said coupler to be lowered when said ramp is raised and raised when said ramp is lowered.

61. The apparatus of claim 60 further comprising said tensioning member operating said second linkage simultaneously with said first linkage.

62. A rail vehicle comprising:

a. a platform;

b. a truck on at least one end of said platform;

c. a coupler provided on said at least one end, said coupler movable between a raised position and a lowered position;

d. said platform having at least one downwardly sloping portion at said end having said coupler;

e. said platform having a ramp provided at said end having said coupler, said ramp having a first end movably connected adjacent a distal end of said downwardly sloping portion, said ramp movable between raised and lowered positions at which a second end of said ramp extends substantially to around level; and f. wherein said coupler is lowered when said ramp is lowered and raised when said ramp is raised, and said lowered position of said coupler provides clearance between said coupler and said ramp when said ramp is in said lowered position.

63. A rail vehicle comprising:

a. a platform;

b. a truck on at least one end of said platform;

c. a coupler provided on said at least one end, said coupler movable between raised and lowered positions;

d. said platform having a ramp provided at said end having said coupler, said ramp movable between a raised position and a lowered position at which an end of said ramp extends substantially to ground level; and e. wherein said coupler is caused to be lowered when said ramp is lowered and caused to be raised when said ramp is raised.

* * * * *

UNITED STATES PATENT AND TRADEMARK OFFICE

CERTIFICATE OF CORRECTION

PATENT NO. : 6,736,071 B2
DATED : May 18, 2004
INVENTOR(S) : Thomas H. Engle

It is certified that error appears in the above-identified patent and that said Letters Patent is hereby corrected as shown below:

Column 24,
Line 34, change “around” to -- ground --.

Signed and Sealed this

Twenty-seventh Day of July, 2004

JON W. DUDAS
*Acting Director of the United States Patent and Trademark Office*